US010689223B2

(12) United States Patent
Chastain et al.

(10) Patent No.: US 10,689,223 B2
(45) **Date of Patent: *Jun. 23, 2020**

(54) CABLE REEL AND REEL CARRYING CADDY

(71) Applicant: PERFECTVISION MANUFACTURING, INC., Little Rock, AR (US)

(72) Inventors: Robert J. Chastain, Maumelle, AR (US); Denton McDonald, Searcy, AR (US); James S. Carter, Denver, CO (US); Chrispin A. Bowen, Little Rock, AR (US); David A. Kelly, Alexander, AR (US); Glen David Shaw, Conway, AR (US)

(73) Assignee: PERFECTVISION MANUFACTURING, INC, Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/360,443

(22) Filed: Mar. 21, 2019

(65) Prior Publication Data

US 2019/0218054 A1 Jul. 18, 2019

Related U.S. Application Data

(63) Continuation of application No. 15/842,254, filed on Dec. 14, 2017, now Pat. No. 10,239,725, which is a continuation of application No. 13/646,217, filed on Oct. 5, 2012, now Pat. No. 9,908,737.

(60) Provisional application No. 61/627,261, filed on Oct. 7, 2011.

(51) Int. Cl.

| | |
|---|---|
| ***B65H 49/20*** | (2006.01) |
| ***B65H 49/32*** | (2006.01) |
| ***B65H 75/18*** | (2006.01) |
| ***B65H 75/30*** | (2006.01) |

(52) U.S. Cl.

CPC ..... *B65H 49/205* (2013.01); *B65H 49/322* (2013.01); *B65H 49/325* (2013.01); *B65H 49/328* (2013.01); *B65H 75/185* (2013.01); *B65H 75/30* (2013.01); *B65H 2701/534* (2013.01)

(58) Field of Classification Search

CPC .. B65H 49/205; B65H 49/322; B65H 49/325; B65H 49/328; B65H 75/185; B65H 75/30; B65H 2701/534

See application file for complete search history.

(56) References Cited

U.S. PATENT DOCUMENTS

| | | | | |
|---|---|---|---|---|
| 2,268,547 A * | 1/1942 | Haines | A01K 97/06 | 242/137.1 |
| 3,696,697 A * | 10/1972 | Hoffman | B23K 3/063 | 83/649 |
| 4,541,586 A * | 9/1985 | Crowe | B65H 49/327 | 242/129.5 |

(Continued)

*Primary Examiner* — Michael E Gallion

(74) *Attorney, Agent, or Firm* — Paul D. Chancellor; Ocean Law

(57) ABSTRACT

A cable caddy with a portable housing stores cable reels. Each reel includes a drum coupled to end caps. Plugs inserted in the end caps are irrotatable with respect to the housing and rotatable with respect to the drum. During transport reels are stacked vertically atop one another with a plug of a first reel inserted in a plug of a second reel.

15 Claims, 27 Drawing Sheets

(56) References Cited

U.S. PATENT DOCUMENTS 5,224,662 A * 7/1993 Kaussen ..... B65H 49/26 242/129.51
5,251,841 A * 10/1993 Takatori ..... G03B 17/30 242/348
5,704,479 A * 1/1998 Barnett ..... B65D 85/04 206/395
5,775,621 A 7/1998 Sauber
6,045,087 A * 4/2000 Vislocky ..... B65H 75/14 242/608.2
6,145,780 A * 11/2000 Fontana ..... B65H 49/24 242/400
6,234,421 B1 * 5/2001 Cox ..... B65H 75/14 242/588
6,341,691 B1 * 1/2002 Voss ..... B65D 85/676 206/397
6,352,215 B1 3/2002 Cash
6,375,116 B1 * 4/2002 Askins ..... B65H 75/185 242/599.2
6,523,777 B2 2/2003 Gaudio
8,016,222 B2 * 9/2011 Galgano ..... B62B 1/14 242/403
8,251,212 B2 * 8/2012 Dunlap ..... B65D 85/04 206/403
8,371,519 B2 * 2/2013 McManus ..... B65D 5/5052 242/129.6
9,902,583 B2 * 2/2018 Tanaka ..... B41J 15/04
9,908,737 B2 * 3/2018 Chastain ..... B65H 49/322
10,239,725 B2 * 3/2019 Chastain ..... B65H 49/322
2001/0006202 A1 * 7/2001 Inana ..... B65H 16/06 242/348
2005/0035240 A1 * 2/2005 Weck ..... B65D 85/04 242/588.4
2006/0231672 A1 * 10/2006 Eastwood ..... B65H 49/322 242/588.2
2007/0125897 A1 * 6/2007 Wijerama ..... B65D 5/4295 242/171
2010/0078514 A1 * 4/2010 Thompson ..... B65H 49/32 242/588
2010/0314484 A1 * 12/2010 Houston ..... A45C 3/00 242/588.3
2011/0240791 A1 * 10/2011 Lindley ..... B65H 75/14 242/609
2012/0091249 A1 * 4/2012 Crossett ..... B65H 49/322 242/580
2012/0168554 A1 * 7/2012 Blunt ..... B65D 85/04 242/588.2
2014/0027553 A1 * 1/2014 Page ..... B65H 16/005 242/159

* cited by examiner

CABLE REEL AND REEL CARRYING CADDY

CROSS REFERENCE TO RELATED APPLICATION

This utility patent application is a continuation of U.S. patent application Ser. No. 15/842,254 filed Dec. 14, 2017 which is a continuation of U.S. patent application Ser. No. 13/646,217 filed Oct. 5, 2012 now U.S. Pat. No. 9,908,737 and entitled "Cable Reel and Reel Carrying Caddy," U.S. Provisional Patent application entitled "Cable Reel, Dispensing and Carrying Caddy For Reels, and Packaging Thereof," Ser. No. 61/627,261, filed Oct. 7, 2011, by inventors Robert J. Chastain, Denton McDonald, James S. Carter, David Allen Kelly, Chrispin A. Bowen, and Glen David Shaw.

BACKGROUND OF THE INVENTION

Field of the Invention

The present invention relates generally to reels or spools containing wire or cable. More particularly, the present invention relates to cable reels and reel housings or carriers that facilitate the shipment, transportation, dispensing, and installation of elongated wires and cables, particularly coaxial cable. Known prior art related to the reel carrier component of the invention is classified in United States Patent Class 242, Subclasses 588, 588.1, 588.2 and 588.3 and in Class 206 Subclass 389.

Description of the Prior Art

Reels are well known in the art for storing and dispensing a wide variety of wires, cables and coaxial cables. Coaxial cable is widely used in the satellite and cable television business for distributing wide-band signals to television apparatus and related accessories. Various other cables, including multi-conductor cables and fiber-optic cables, are widely used for Internet-related applications, and digital data transmission and distribution in conjunction with diverse computer networks, including local-area and wide-area networked systems. Wired computer networks are the backbone of the Internet.

Reels for storing wires and cables typically include a hollow, tubular core extending between spaced apart ends or flanges. In general, wire wound around the core is held in place by the flanges. Reels containing flexible media that are intended for industrial transport and storage vary greatly in size. Reels have traditionally been fabricated out of wood or metallic materials, and have more recently been fabricated from paper and plastic.

In the prior art, it is known to house coils of cable in boxes, and to manually pull selected lengths of cable out of the box. Wires and cables are conventionally wound around reels or "spools" that may be packaged in various forms of containers. A wide variety of prior art configurations exist. Traditional packaging methods such as cardboard, wood or metal are inefficient and non-standardized, and are bulky and heavy due to the typical packaging materials required for transportation and use. Boxes of cable are heavy and difficult to move around. Boxed reels also require the additional steps of removing tape or straps sealing the box before the cable can be removed. These problems are amplified by the fact that modem, large scale construction projects require large lengths of numerous cables of different types, thicknesses and characteristics. In large complex jobs, numerous boxes of various cables quite often end up haphazardly placed around the work site in a disorganized manner. Empty reels and packaging typically cannot be reused and have to be disposed of as waste.

It is known in the art to rotatably support wire reels within a portable enclosure that functions as a housing and carrying case. Such rotating reel assemblies include a reel that is rotatably connected to a frame within a box or generally parallelepiped enclosure. The rotating reel assembly permits the user to simply pull out the cable. Some designs include an axle that penetrates the spool and is rotatably coupled between suitable end points in the supporting frame that enable rotation. However, these arrangements often do not feed as well when the cable is pulled at an angle and they require that the axle be detached from the frame and withdrawn from the reel to remove and replace an empty spool. Typically, ends of the supportive spool axle are fitted within inexpensive frame cradles that enable rotation and function as inexpensive bearings. Such designs make it easier to remove the spools but, over time, the reliability and durability of the support cradle are compromised.

For example, as cable is drawn from conventionally designed spools, the spool tends to wear out the support cradles or bearings due to the weight of the cable and the minimal surface area contact between the spool and bearings. This can cause the spool to wobble or bind restricting wire or cable from being unwound. As wire or cable is removed from the spool there may not be sufficient friction to allow the spool to stop spinning, resulting in the spool "freewheeling" allowing wire or cable to unwind faster than it can be conveniently pulled away by the technician. This can result in cable tangles or spool misalignment. The installing technician must then waste potentially valuable time untangling cables and adjusting the spool or reel.

In the prior art, U.S. Pat. No. 8,016,222 issued Sep. 13, 2011 discloses a wire or cable dispensing cart with several reels of cable in cartons. Cable is pulled through a slot in the carton's front panel. Preferably, left and right panels of the carton each have an arbor hole formed therein which receives an axial rod, the rod also extending through the reel and caddies. In one embodiment, cable may be pulled through one or more pass-through slots formed in the tops and bottoms of stacked containers, such that cable from multiple containers is drawn through one slot on the top of the stack.

U.S. Pat. No. 6,523,777 issued Feb. 25, 2003 shows a portable wire spool caddy that releasably holds a cylindrical spool while cable is unwound from the spool. An elongated frame includes first and second spaced apart ends, a plurality of parallel rods which each extend between and are connected to the first and second ends, and at least one movable rod which is generally parallel to the fixed rods which extends between the ends. The spool is retained between the movable rod and the fixed rods, and when the movable rod is in its second position the spool may be removed or inserted between the movable rod and the adjacent fixed rod.

U.S. Pat. No. 6,234,421 issued May 22, 2001 discloses a reel for supporting wound cables. The reel has a core, first and second flanges, and at least one locking ring. The core has first and second ends, an inner surface and an outer surface. The first flange, which attaches to the first end of the core, includes a first plurality of flexible fingers that extend axially inward the core adjacent to said inner surface proximate the first end. The second flange attaches to the second end of the core and includes a second plurality of flexible fingers that extend axially inwardly proximate the second end. The locking ring urges the first plurality of flexible fingers to the inner surface proximate the first end.

U.S. Pat. No. 5,775,621 issued Jul. 7, 1998 discloses a combination reel caddy and stand for cable spools of the type having a central drum and enlarged disk-like ends with central openings therein. The stand comprises a generally U-shaped handle portion having a curved end and elongated leg portions with the leg portions carrying stub spindle members adapted to be received in the spool disk. The spool can be rotated and lifted about the legs and then with the handle portion on the same surface as the ends of the stand legs the spool can be freely rotated for unwinding or winding cable therefrom.

Thus, a suitable reel caddy should be designed with considerations for transportation and storage of the reel caddy both with the reel loaded into the caddy and separately. The design should allow for minimal consumption of volume on pallets and in bulk shipping containers. Caddies and reels that can be efficiently stacked will reduce transportation and storage costs. A design that incorporates shipping into the reel and caddy can also reduce waste in unnecessary packing materials to stabilize and protect the reel and caddy in transit.

For instance if the reels have a shape and features that allow them to be stacked end-to-end vertically, and minimize wasted space when the stacks are combined on a pallet or in a shipping container, volume required for transportation and storage can be reduced. If the caddies can be stacked efficiently like the reels then a further reduction in transportation and storage costs results. An added benefit of a reel caddy designed and built in the manner is that shipping and storage damages is also minimized due to the stable configuration of the reel caddy during shipping.

In addition to the shape, if the reel caddy is designed and fabricated using durable, lightweight materials, more product can be transported more easily at lower cost, with less damage to the product. Cardboard boxes may be lightweight, but are not as durable as plastic and are susceptible to weather conditions. Wood or metal containers are strong and weather resistant but typically take up more space and weight more than plastic containers. Lightweight, durable plastic is an ideal material for a reel caddy for shipping, storage and day-to-day use.

A primary feature of a reel caddy is that it be perform the task of dispensing cable, wire or fiber at a work site and allow the installer or other user to perform their job efficiently and effectively. An installer typically carries all tools and cable in a vehicle. A reel caddy that can easily be stored and efficiently stacked in a vehicle is important. Installers may require multiple types of cable, wire or fiber, and may also carry multiple spare reels as well. So not only must the reel caddy itself be easily stored in a vehicle, the reels must also meet the same criteria.

Once an installer reaches a jobsite, all of the installer's tools and need to be moved to the location where work is being performed. The reel caddy must easily stack and remain stable on a dolly, handcart, or other carrying device two-wheel. Weight must also be minimized to help in transportation of the reel caddy. A reel caddy with matching interlocking tops and bottoms allows stacking of multiple caddies vertically in a stable column. A comfortable carrying handle is also a requirement to enable an installer to carry a reel caddy in each hand. Additional hand holds are desirable to allow the caddy to be lifted regardless of its orientation. Reels in cardboard boxes tend to tear and are harder to grip. The capability for the installer to easily open the caddy when needed, preferably with one hand, to install a reel or switch reels is desirable.

The reel caddy must provide a smooth flow of cable, wire or fiber from the caddy. The shape and position of the outlet is important in providing this feature. If the cable snags on the outlet, then the caddy or container could be dragged across the work site. The cable must feed freely regardless of the angle of pull from the mouth of the caddy. The reel caddy must also provide sufficient friction to stop the feed of cable from the caddy once the installer stops pulling. A reel that keeps spinning, or "freewheels," in the caddy results in tangled cable that may require significant time to untangle so that the installer's work can continue. A reel caddy that includes a variable braking capability between the reel and bearing surfaces meets these criteria by providing greater braking friction when the reel is full, and reducing braking friction as the reel is emptied.

A reel caddy should also be stable and contain the reel in various positions, even upside down. A reel caddy that provides a secure latching mechanism and is designed to stabilize the reel and even feed cable or wire regardless of the orientation is desirable.

Installers may simultaneously install multiple types of cable and wire, pulling all cable and wire at the same time, so a reel caddy that can contain different types of cable and wire and can be stacked with interlocking feet on the bottom and indentions in the top makes this a simple task for the installer. To minimize reel replacement, a desirable reel caddy should be able to effectively contain as much cable as can be carried or transported around the work site easily, for instance one-thousand feet of RG-6 coaxial cable. It is important to be able to determine how much cable is left on a reel so that there is sufficient cable for a particular job, or so that an installer can insure that spare reels are available. A reel caddy that can be opened to allow full observation of the cable on the reel is essential. While visual inspection is important, electronic tools exist that can measure both the length and quality of cable on a reel. In order to use such an electronic tool, an installer must have access to both ends of the cable on the reel, making this access a critical feature of a reel caddy. Not to be overlooked is the ability to visually determine the type of cable on a reel. Even though the cable may be marked, access to the entire reel can usually make identification of the cable type easier than having to pull out sufficient cable to find the markings.

A work site is full of challenges for a reel caddy in that the caddy may be located on gravel, concrete, dirt or even in mud. The caddy may also be exposed to the elements such as rain, snow or direct sunlight and high heat or extreme cold. Undoubtedly a reel caddy on a work site will be banged, dropped, slid across the ground, and generally abused. It is critical for a suitable reel caddy to be durable enough to take the abuse, protect the cable, and continue to function effectively. The reel caddy must also protect the cable from the elements and maintain its integrity.

Features that help reduce the risk of theft are virtually non-existent in current cable deployment systems. An effective reel caddy should include features that help reduce theft but do not hinder use of the caddy. For example a reel including unique spindle keys that are matched between reel and caddy or unique to a particular user, reels with no through hole to prevent insertion of a common rod or pole as an axle, and color coded reels and caddies, are all desirable features. An environmentally friendly reel caddy is desirable, ideally a solution that can satisfy multiple uses and can be reused, and that does not generate waste by requiring any significant packing materials for transportation or use. A suitable reel caddy should work with a wide variety of cable, wire and fiber types. The reel should have the capability to be respooled by the owner or by returning to the distributor. A reel caddy made of lightweight durable materials can reduce consumption of fuels in transportation. A reel caddy where the reel and caddy have been designed for efficient stacking to maximize stability, minimize damage, and minimize additional packaging material can reduce waste packaging material and reduce storage space requirements in transportation, storage, and on a work site.

SUMMARY OF THE INVENTION

A resilient plastic, two piece caddy comprising a portable housing for storing reels of cable or wire. A lower base forms an enclosure in which a reel can be rotatably mounted. A pivoted top hinged to the base can enclose the caddy. A handle enables the box-like enclosure to be conveniently carried.

Each reel comprises a spool of cable or wire. The spool has a central axle coupled at each end to spaced apart, flange-like end caps that restrain wound wire. The end caps have inner portions coupled to the axle, and outer, bearing races coaxial with the axle to which molded plastic spindles are coupled to enable rotation. Each spindle comprises a projecting bearing portion rotatably engaging the bearing race defined in each end cap, and an outwardly projecting hub adapted to be placed within suitable gudgeons internally defined within opposite caddy ends to rotatably mount the reel.

A preferably single-piece spindle is permanently mounted to and captivated by one reel end cap. An opposite, multi-piece spindle comprises a captivated bearing portion that is likewise engaged with a bearing race within the adjacent end cap, and a separate removable hub. The separate removable hub is axially coupled to a socket defined within its companion bearing structure. When reels are mounted in the caddy for use, the single-piece spindle hub and the removable spindle hub are axially aligned, and both seat within gudgeons in opposite caddy ends to establish reel rotation. The removable hub forms a security key that can be designed to fit only selected reels with matching sockets. Alternatively, the removable hub can be keyed to specific gudgeons.

The removable hub contributes a functional advantage to reel stacking or transportation. When bulk reels are shipped, or when two or more similar reels are transported about a work site, reels may be stacked vertically atop one another with the separate spindle hub removed. In this case, the opposite spindle hub will engage the now-exposed socket of an upper reel stacked upon it. The stacked and partially interlocking hubs promote stability during transportation.

Thus, a broad object of this invention is to provide an improved reel and carrying caddy for handling the reel for transporting and dispensing wires, coaxial cable, and the like.

Another object is to provide a caddy for efficiently and reliably carrying spools or reels of cable or wires.

A related object is to provide a carrying caddy that allows efficient and reliable replacement of depleted reels.

A basic object is to provide a cable dispensing caddy that eases the job of cable installers and promotes work site efficiency.

A related object is to provide a cable or wire dispenser that avoids cable entanglements while allowing smooth deployment of cable, wire, fiber and the like.

Another related object is to provide a caddy of the character described that enables an observer to quickly visually identify the amount of unused cable that remains on a reel.

Yet another object is to reduce shipping costs per standard measure by optimizing the caddy and reel designs for efficient stacking and placement on pallets and in containers.

A related object is to provide a cable spool design that enables reels to be quickly and stably stacked in vertical columns within pallets for efficient shipment.

Another related object is to make the transportation of cable spools easier and more convenient. It is a feature of our invention that reels can be vertically stacked in stable columns, with the spindle of a reel below engaging an exposed socket of a spindle above.

Yet another object of the present invention is to provide a rotating cable caddy of the character described that reliably journals the reel, while facilitating easy reel replacements thereby eliminating time consuming adjustments or the need for special tools.

It is also an object to provide security features to a cable caddy. It is a feature of our invention that specific reels can be provided with a matching spindle hub or "key" that must be inserted within that reel to fit within a matching caddy.

Thus a specific brand and type of cable on an appropriate "approved" reel can be matched for use with a previously vended or provided caddy that is specific to a given manufacturer or cable supplier.

A related object is to provide a carrying case or caddy for rotationally mounting cable reels that can be efficiently shipped. It is a feature of our caddy that multiple units can be stacked together vertically in stable, columns where individual caches are nested together.

Providing a "green" system is also a basic object. It is a feature of our arrangement that the caddies and reels are reusable and recyclable. Because of pallet optimization, less space is required for shipping. Finally, the designs described herein substantially obviate the need for cardboard or paper boxes or containers that form waste that must be disposed of using energy resources and landfill space.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
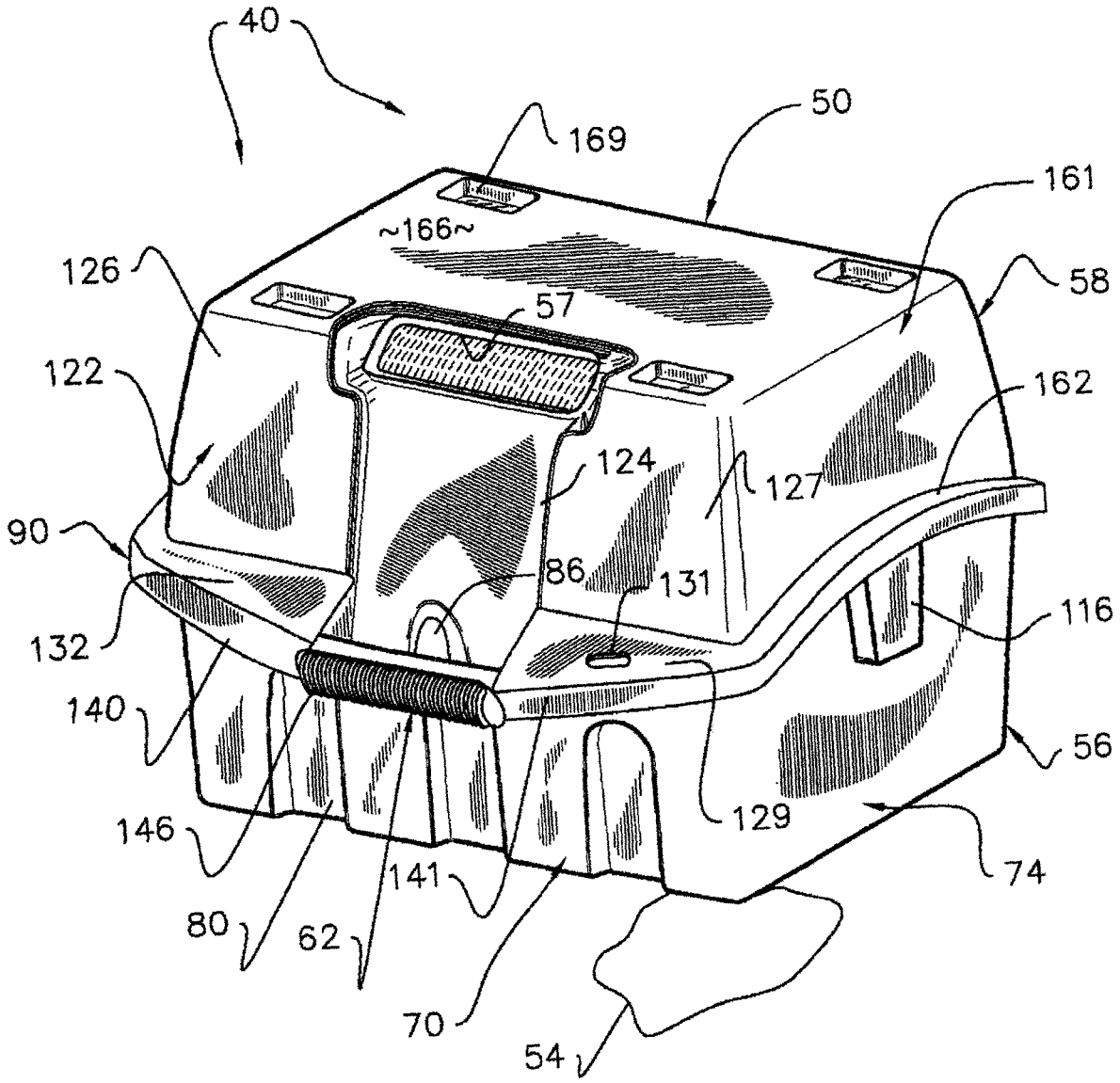
FIG. 1 is a frontal isometric view of an embodiment of our cable reel caddy, with the caddy closed.
Figure 2:
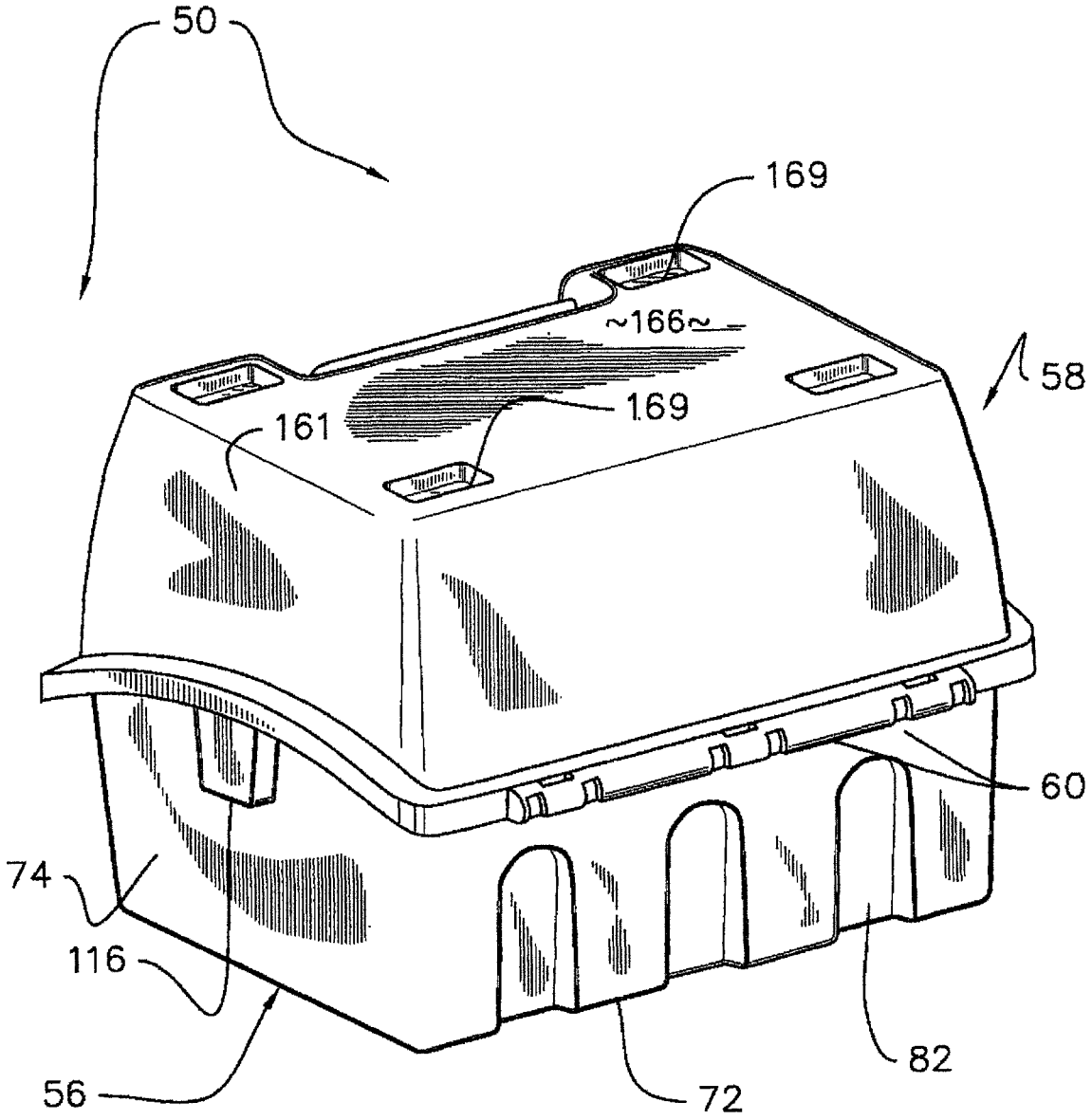
FIG. 2 is a rear isometric view of the closed cable caddy.

Referring initially to FIGS. 1-12 of the appended drawings, a system for housing and carrying reels of coaxial cable or wire, and for dispensing cable or wire, has been generally designated by the reference numeral 40. The system 40 comprises a protective, portable caddy 50 for housing a reel 52 (FIGS. 9, 10) containing wound coaxial cable (or other filamentary wire or cable) that may be rotatably disposed. Ideally, the caddy 50 is disposed upon a suitable available supporting surface 54 proximate to a work site where various types and lengths of cable are to be installed. Bottom caddy feet 59 (FIGS. 3, 4) provide support and stability. The impact resistant, plastic caddy 50 comprises a lower base 56 that forms an enclosure in which reel 52 sits, and a cooperating top 58 that is pivotally coupled to base 56 with an elongated hinge 60 (FIG. 2). Base 56 and top 58 are both generally in the form of an open parallelepiped. When caddy 50 is closed, as in FIGS. 1-5, it may be conveniently transported by grasping a front handle 62 that is formed by abutting handle portions of the base 56 and top 58 when the caddy is closed, as explained in detail hereinafter. Each of top 58 and base 56 are preferably formed of impact resistant plastic and can be created in various combinations of colors to aid in identification of the caddy 50.

Figure 7:
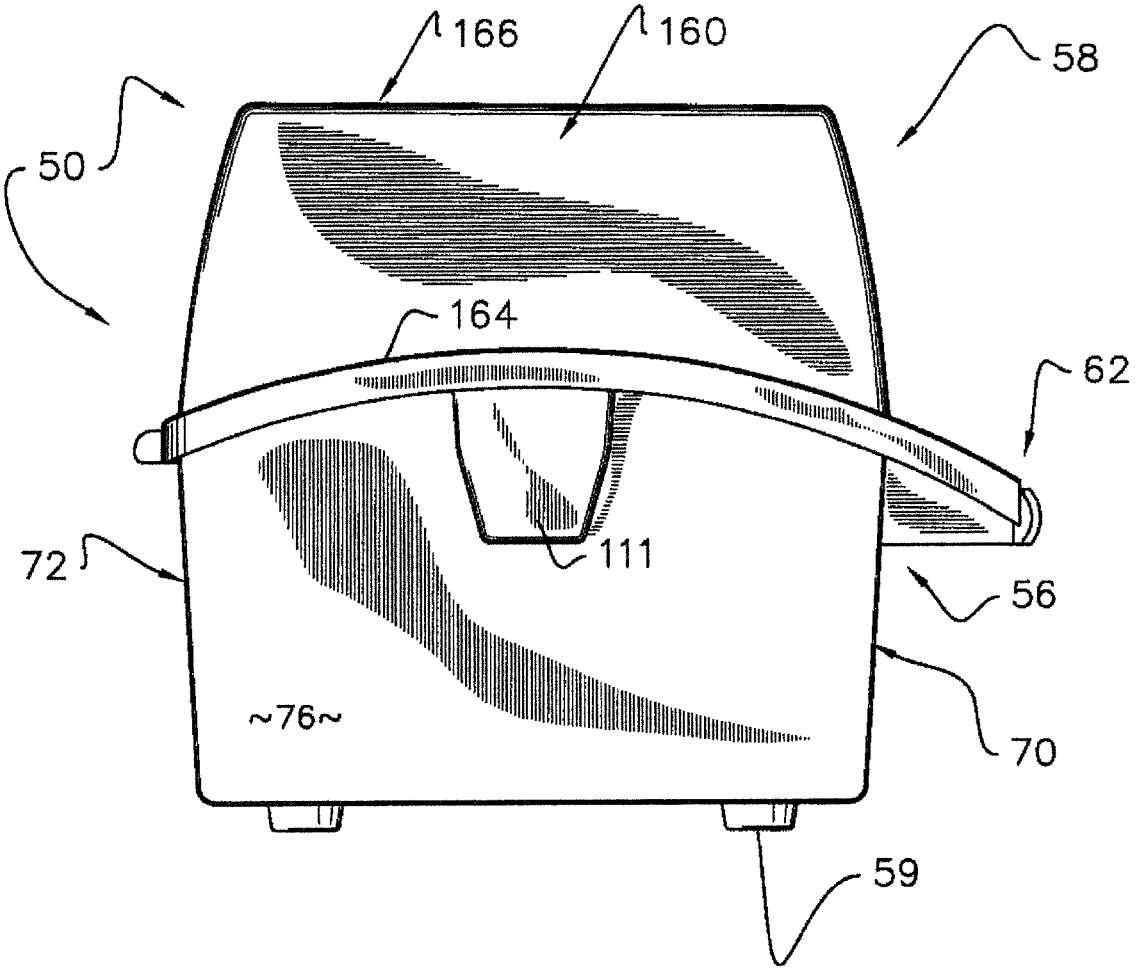
FIG. 7 is a left side elevational view of the closed caddy.
Figure 8:
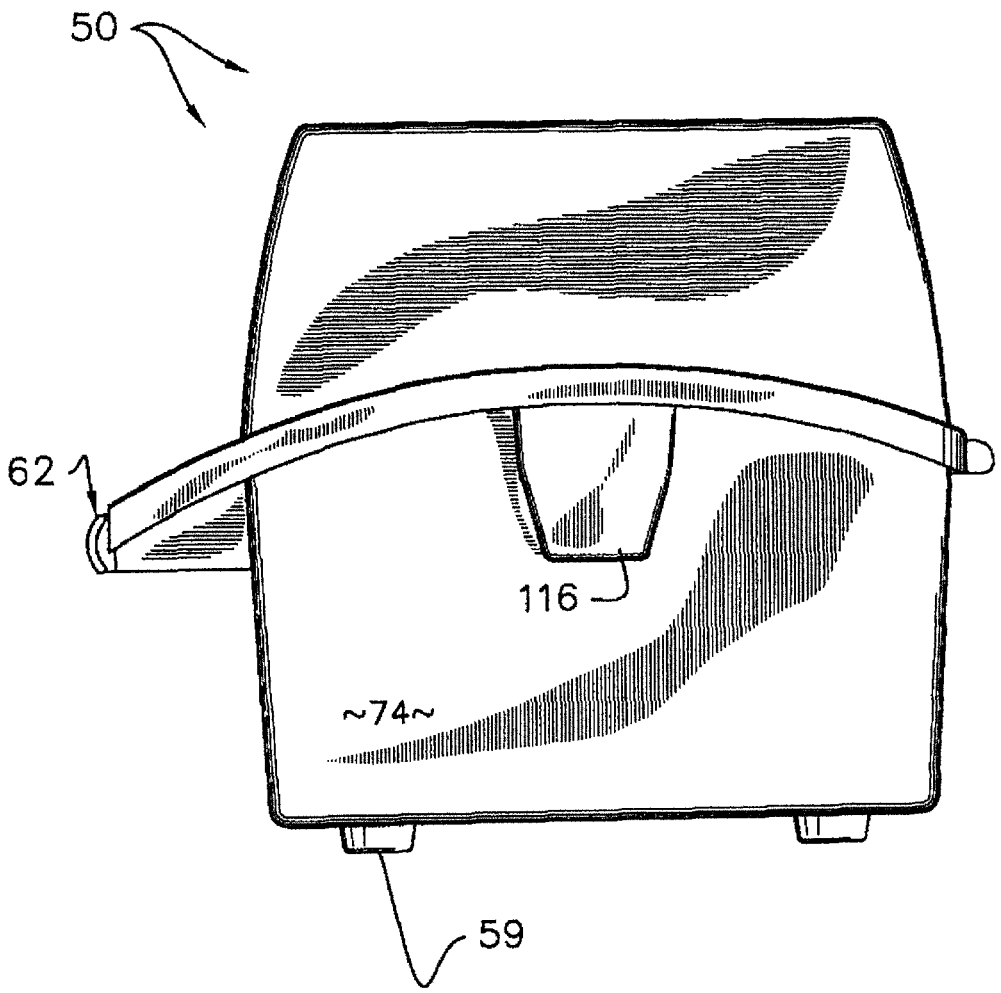
FIG. 8 is a right side elevational view of the closed caddy.
Figure 9:
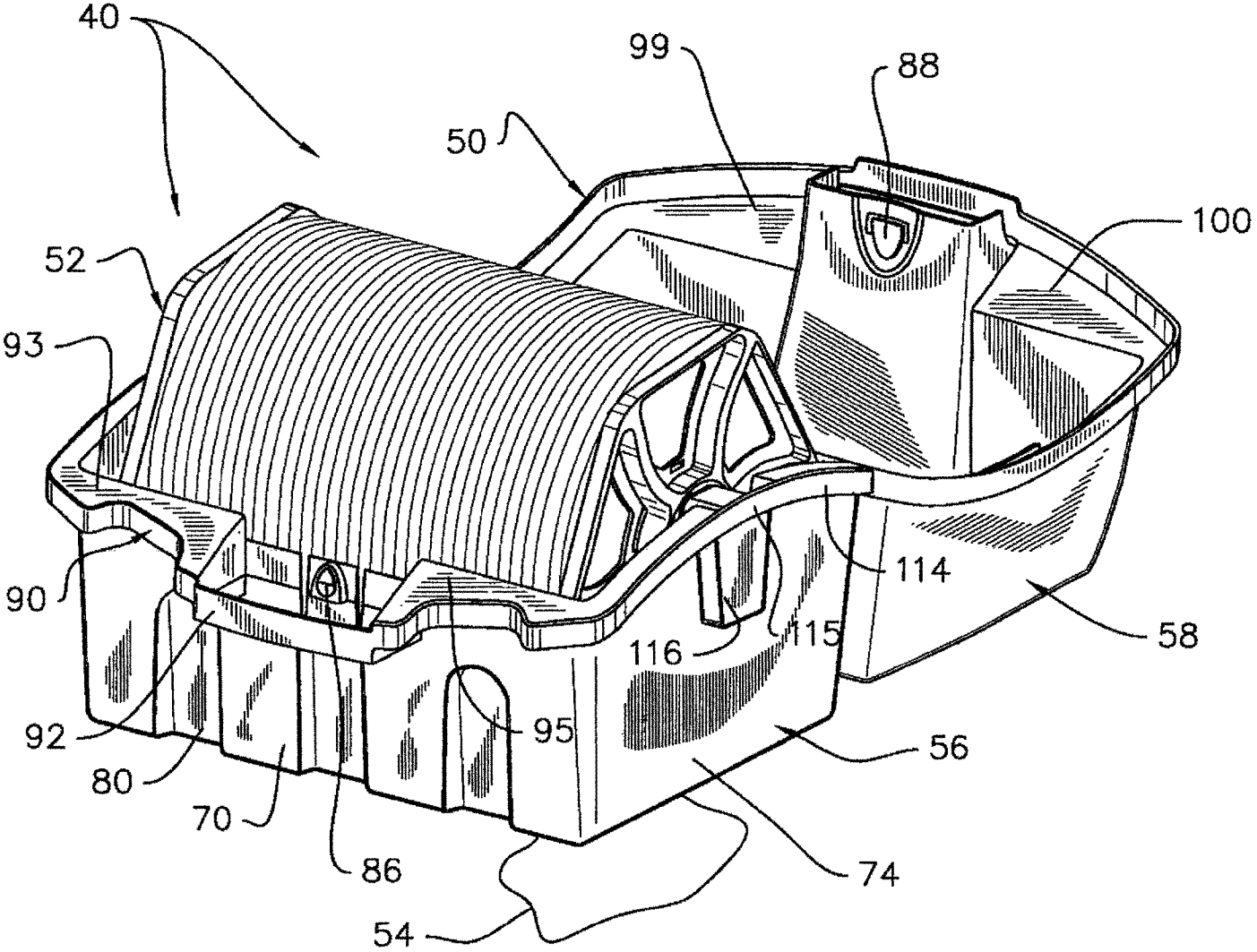
FIG. 9 is a frontal isometric view of a loaded and opened caddy.
Figure 10:
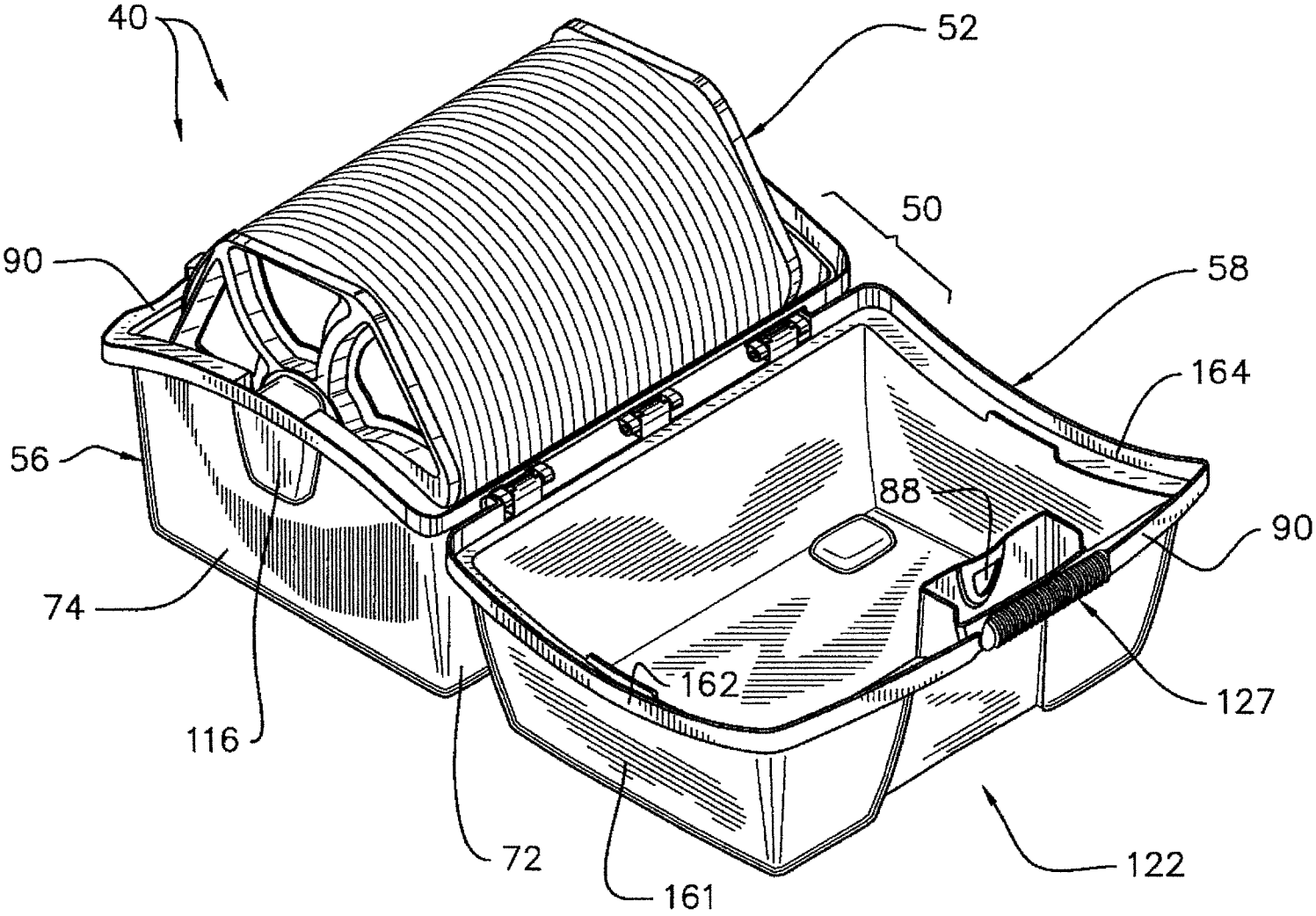
FIG. 10 is a rear isometric view of the loaded and opened caddy.
Figure 11:
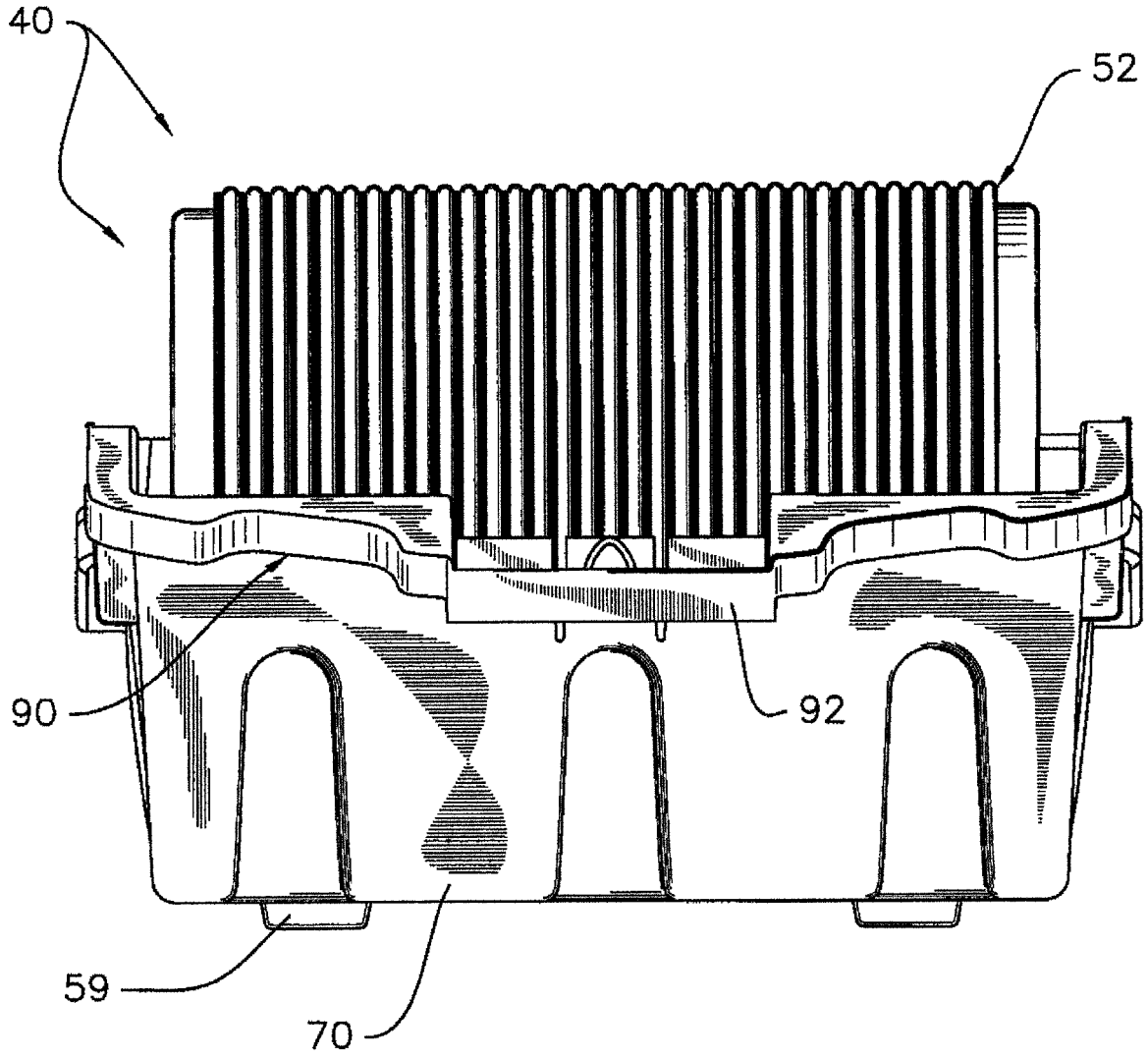
FIG. 11 is a front plan view of the loaded and opened caddy.
Figure 12:
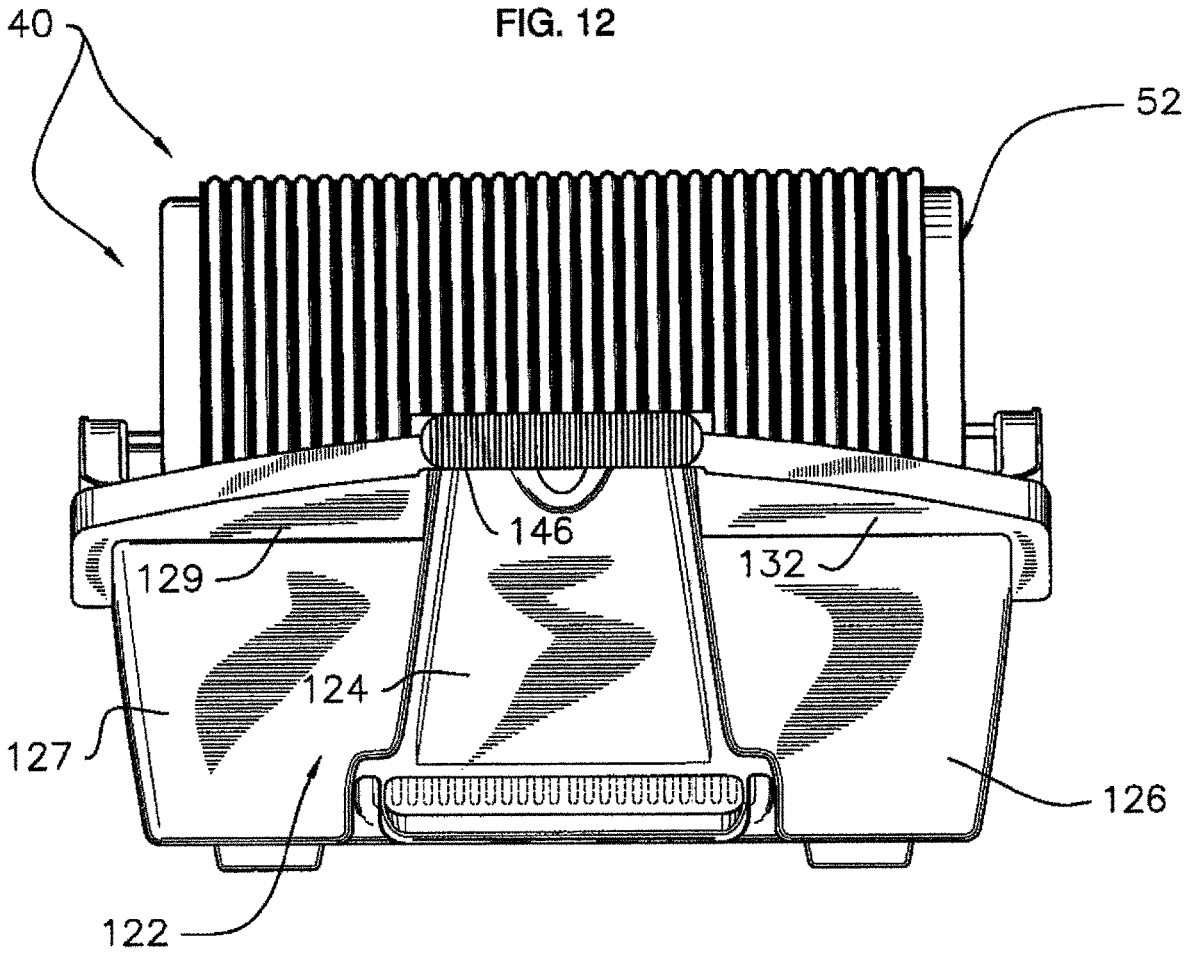
FIG. 12 is a rear plan view of the loaded and opened caddy.
Figure 13:
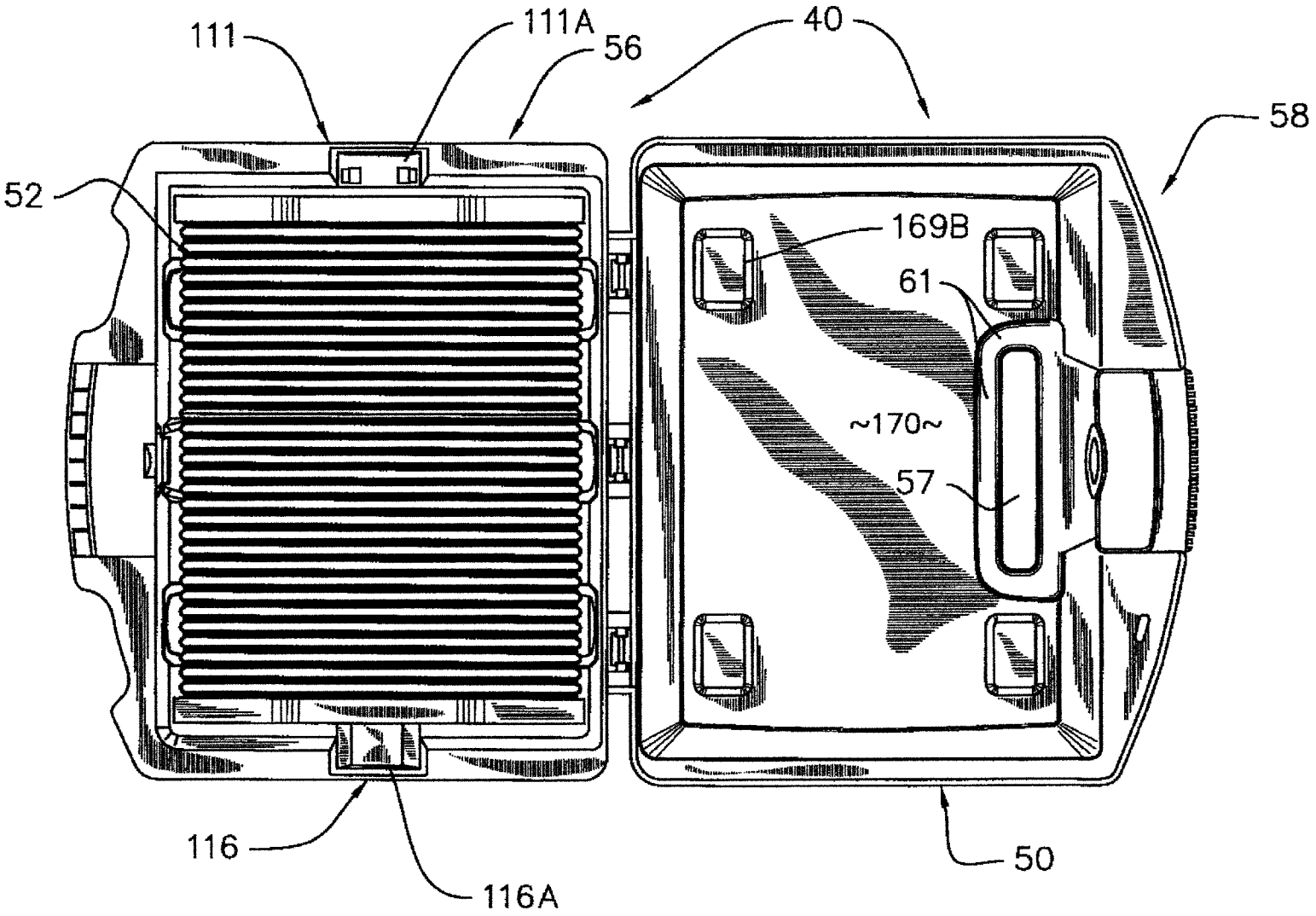
FIG. 13 is a top plan view of the loaded and opened caddy.

Base 56 forms a box-like enclosure comprising a front panel 70 and an integral rear panel 72 (FIG. 7) which are integral with right end panel 74 (FIG. 8) and left end panel 76 (FIG. 7). Front panel 70 has a plurality of spaced part, generally parabolic indentations 80 that reinforce the caddy 50 and add to aesthetic styling. Similar stylistic reinforcement indentations 82 (FIG. 4) are spaced apart on the rear caddy panel 72. At the top of the center indentation 80 on front panel 70 there is a spring-biased button 86 that releasably mates with a similarly contoured, complementary opening 88 formed in the interior of top 58 (FIG. 9, 10) to form a latch. Button 86 may be manually depressed to unengage the opening 88 and allow top 58 to rotate away from base 56 to open the caddy and expose the caddy interior. As seen in FIGS. 1, 2, and 13, top 58 has an upper, slotted front mouth 57 through which cable wound about the enclosed, interior reel 52 may be withdrawn. Mouth 57 is preferably bounded by a peripheral, generally rectangular lip 61 (FIG. 13) of generally cylindrical cross section that lessens friction or resistance as cable is withdrawn through the mouth 57. Other embodiments of mouth 57 have lip 61 covered by a smooth, low-friction grommet, or a plurality of rollers, or other mechanisms (not shown) to reduce friction on cable or wire being drawn from the caddy 50. Still other embodiments of mouth 57 have an alternative lip (not shown) that is curved slightly inwardly or outwardly to reduce friction on cable or wire being drawn from the caddy 50.

Figure 6:
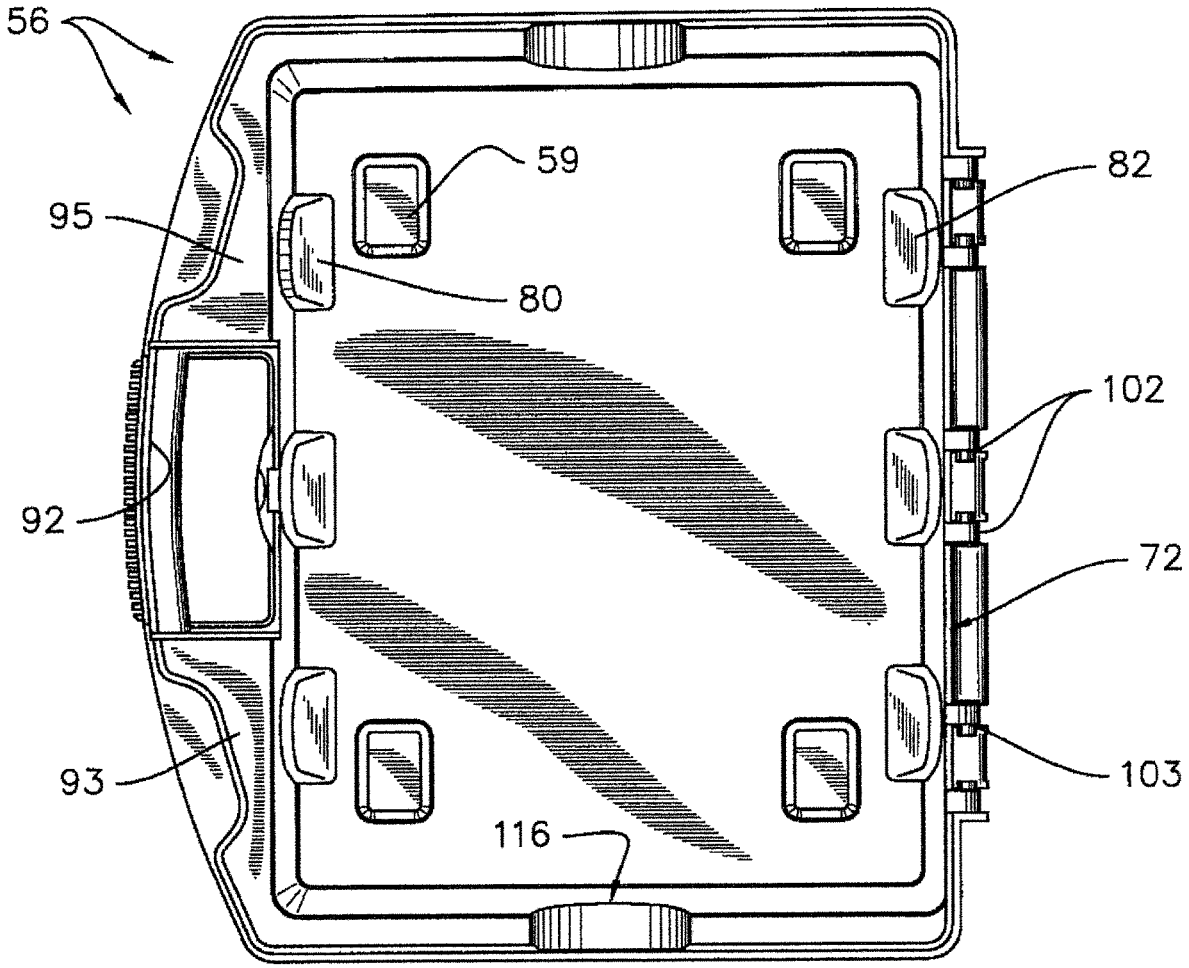
FIG. 6 is a bottom plan view of the closed caddy.

The base 56 also comprises an integral, stylized, frontal ledge 90 (FIGS. 1, 9) that reinforces the structure of the caddy to enable the base to retain its critical dimension and forms its upper periphery. The frontal ledge midportion 92 (FIGS. 9, 11) is offset from button 86 forming a lower half of the handle 62 (FIG. 1) extending integrally across the upper edges of the front panel 70. Ledge 90 comprises spaced apart, lateral triangular portions 93, 95 (FIG. 9) that nest within similarly styled recesses 99, 100 formed in the underside of top 58 (FIG. 9) when the caddy 50 is closed. The rear panel 72 hinge structure (FIG. 4) has a plurality of spaced apart pairs of upper hinge ferrules 102 integrally formed in rear peripheral ledge 104. Each pair of ferrules 102 on the base 56 is coupled to a barrel 106 from the top 58 disposed between it by a clevis pin 103 (FIG. 6). The ferrules 102 and barrels 106 are axially aligned, and form hinge 60 to allow the top 58 to pivot relative to the base 56.

Figure 14:
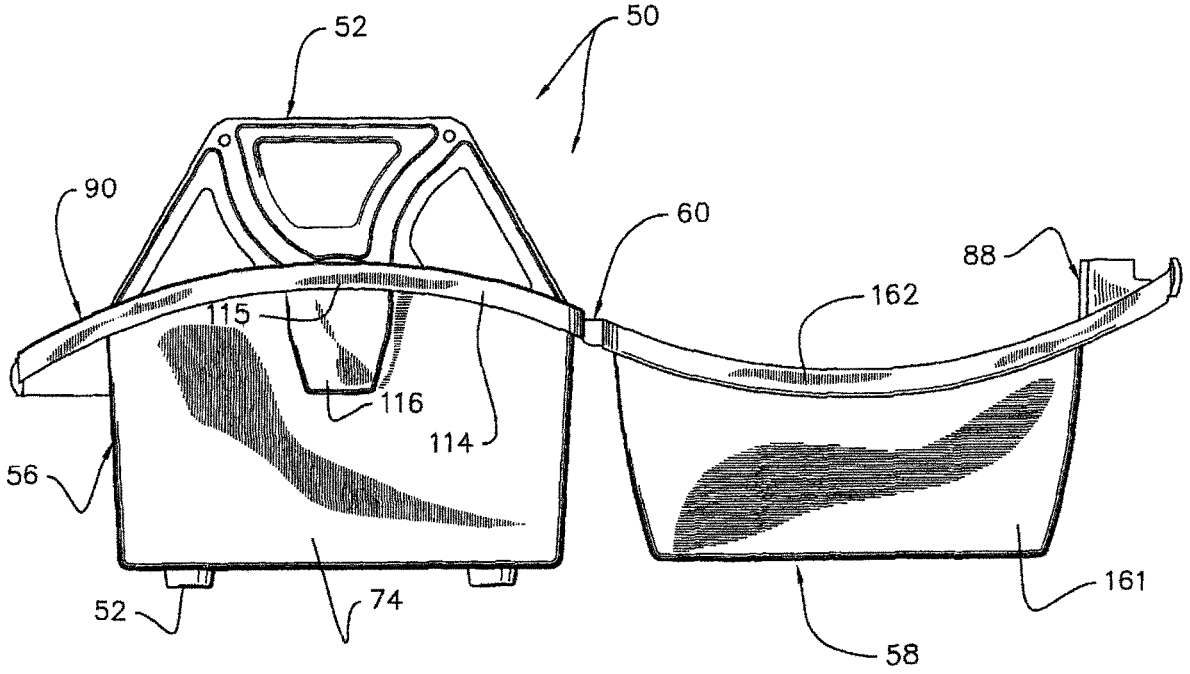
FIG. 14 is a right side elevational view of the loaded and opened caddy.
Figure 15:
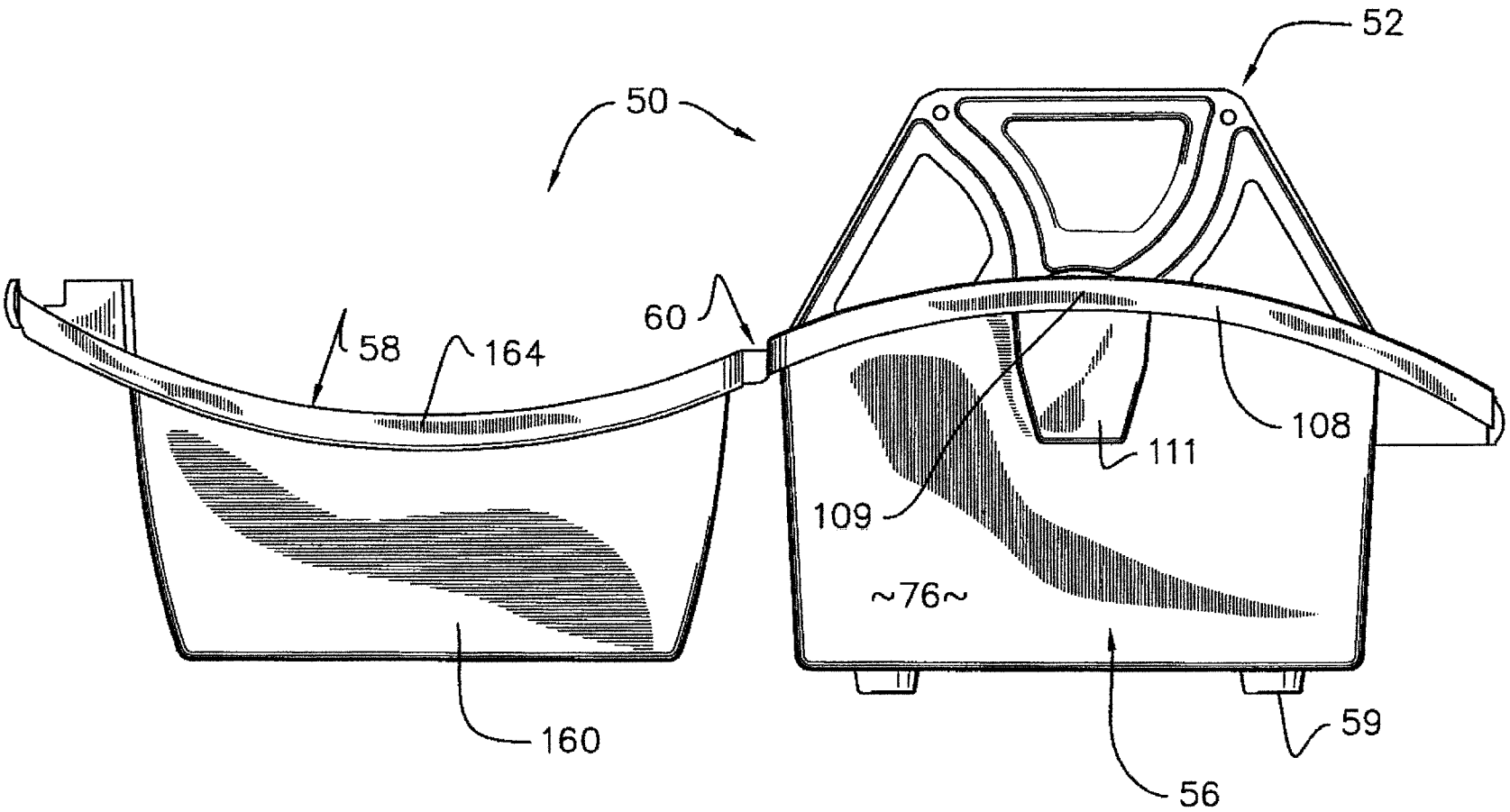
FIG. 15 is a left side elevational view of the loaded and opened caddy.

Each integral end panel 74, 76 (FIGS. 7, 8, 14, 15) of the base 56 also includes an upper peripheral ledge that extends from the rear hinge 60 to the front shelf 90 previously described. For example, left end panel 76 (FIG. 15) has a curved ledge 108 with the higher midpoint 109 centered on panel 76 and disposed above an outwardly projecting bearing housing 111. The opposite, spaced apart right end panel 74 (FIGS. 8, 14) has a complementary curved ledge 114 with a higher midpoint 115 centered on panel 74 above an outwardly projecting bearing housing 116. Ledges 108 and 104 can be utilized as lifting handles when the caddy 50 is closed. The bearing housings 111, 116 define interior gudgeons 111A and 116A respectively that mate with the spindles projecting from the reel 52 (FIG. 13) to rotatably mount the reel 52 as explained hereinafter. The plastic spindles (FIGS. 21-23) discussed later comprise hub portions seated within the receptive inner gudgeons 111A and 116A (FIG. 13) defined by the bearing housings 111, 116 when the reel 52 is disposed within caddy 50.

Figure 3:
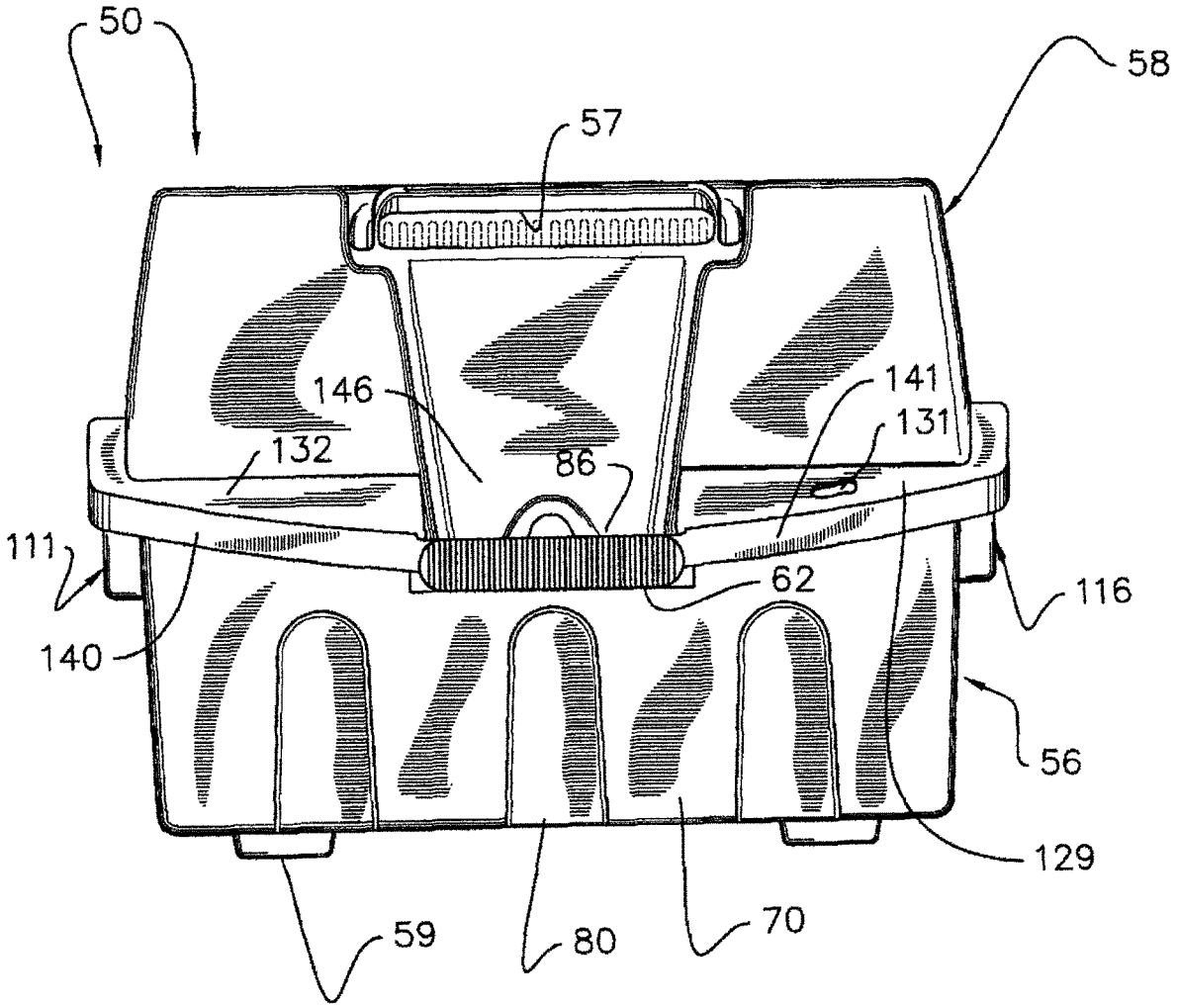
FIG. 3 is a front elevational view of the closed caddy.
Figure 4:
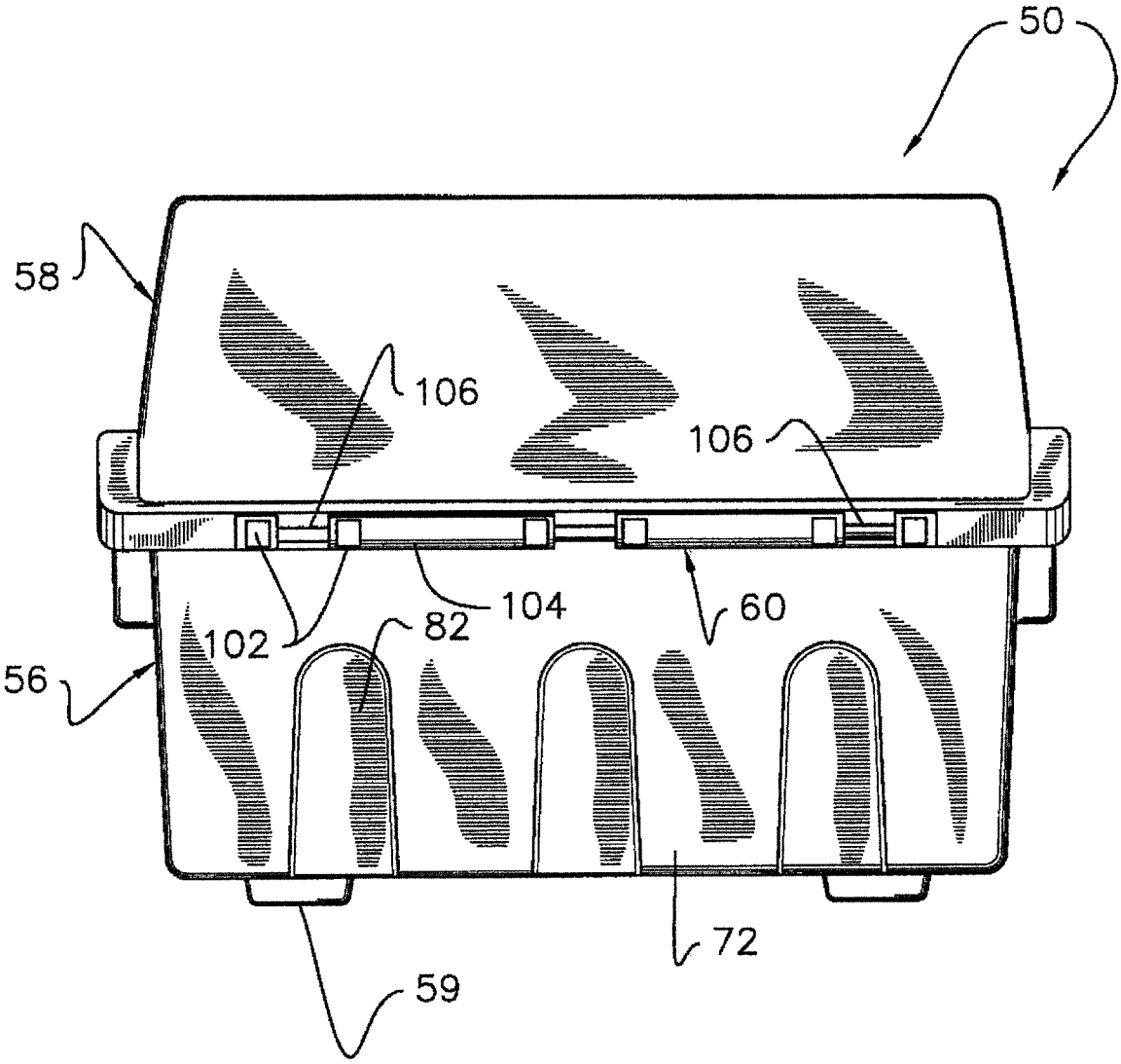
FIG. 4 is a rear elevational view of the closed caddy.
Figure 5:
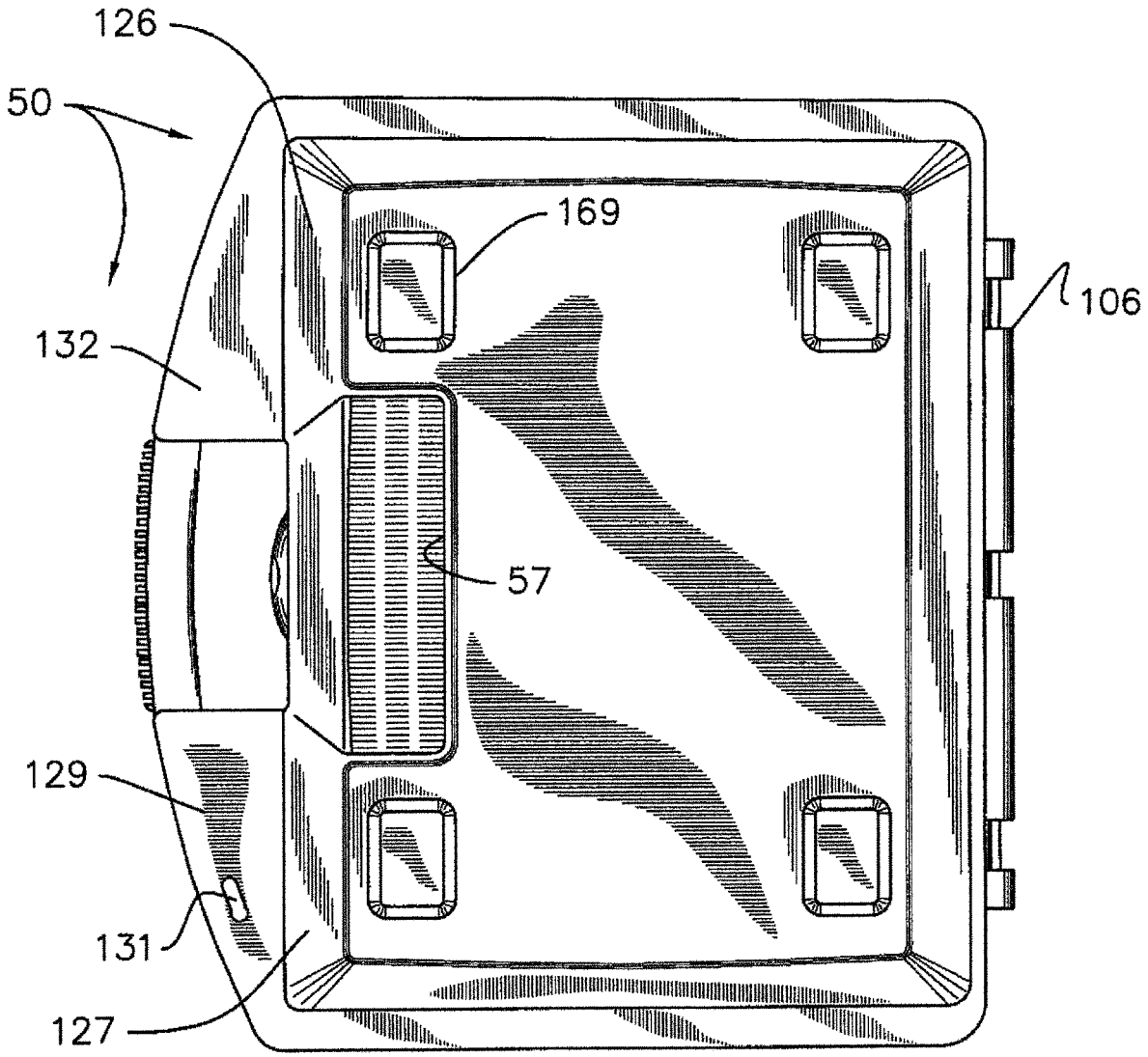
FIG. 5 is a top plan view of the closed caddy.

The caddy top 58 sits atop the base 56 and is pivoted thereto with hinge 60 at the rear as discussed earlier. Top 58 has a front panel 122 (FIGS. 1, 12) with a recessed center portion 124 disposed between integral side portions 126, 127 (FIG. 1). A complementary front ledge 129 projects outwardly from panel portion 127 and a similar opposite ledge 132 projects from panel 122 (FIGS. 1, 3). Preferably there is a wire end catch 131 defined in ledge 129 (FIGS. 1, 5) to temporarily hold loose wire ends. Peripheral borders 140, 141 form the front of ledges 132, 129 and are joined by a handle portion 146 which is part of handle 62. Borders 140, 141 are complementary with and substantially cover the projecting ledge 90 on the base 56 discussed earlier.

End panels 160 (FIG. 7) or 161 (FIG. 1) of the top 58 have arcuate peripheries 164, 162 (i.e., FIGS. 10, 14-15), respectively that mate with and are complementary to base side ledges 108 (FIG. 15) and 114 (FIG. 14) discussed above when the caddy 50 is closed. Importantly, the upper surface 166 (FIGS. 1, 2) of the top 58 has a plurality of generally cubicle indentations 169 disposed generally at the comers of the rectangular surface 166. Indentations 169 are aligned with the feet 59 (FIG. 4) in the base 56. Thus when caddies are vertically stacked atop one another, when for example two or more caddies are transported at the work site on a conventional hand truck or dolly, the feet 59 from an upper caddy can register with the indentations 169 in a lower unit to stabilize the vertical stack. Beneath the upper surface 166 of the top, at the underside 170 (FIG. 13) the indentations have projecting nubs 169B. When empty caddies are stacked in the open position for shipping, as discussed later, the indentations 169 (FIG. 2) in one caddy can register with the projecting indentations 169B (FIG. 13) in a lower stacked caddy for stability.

Figure 16:
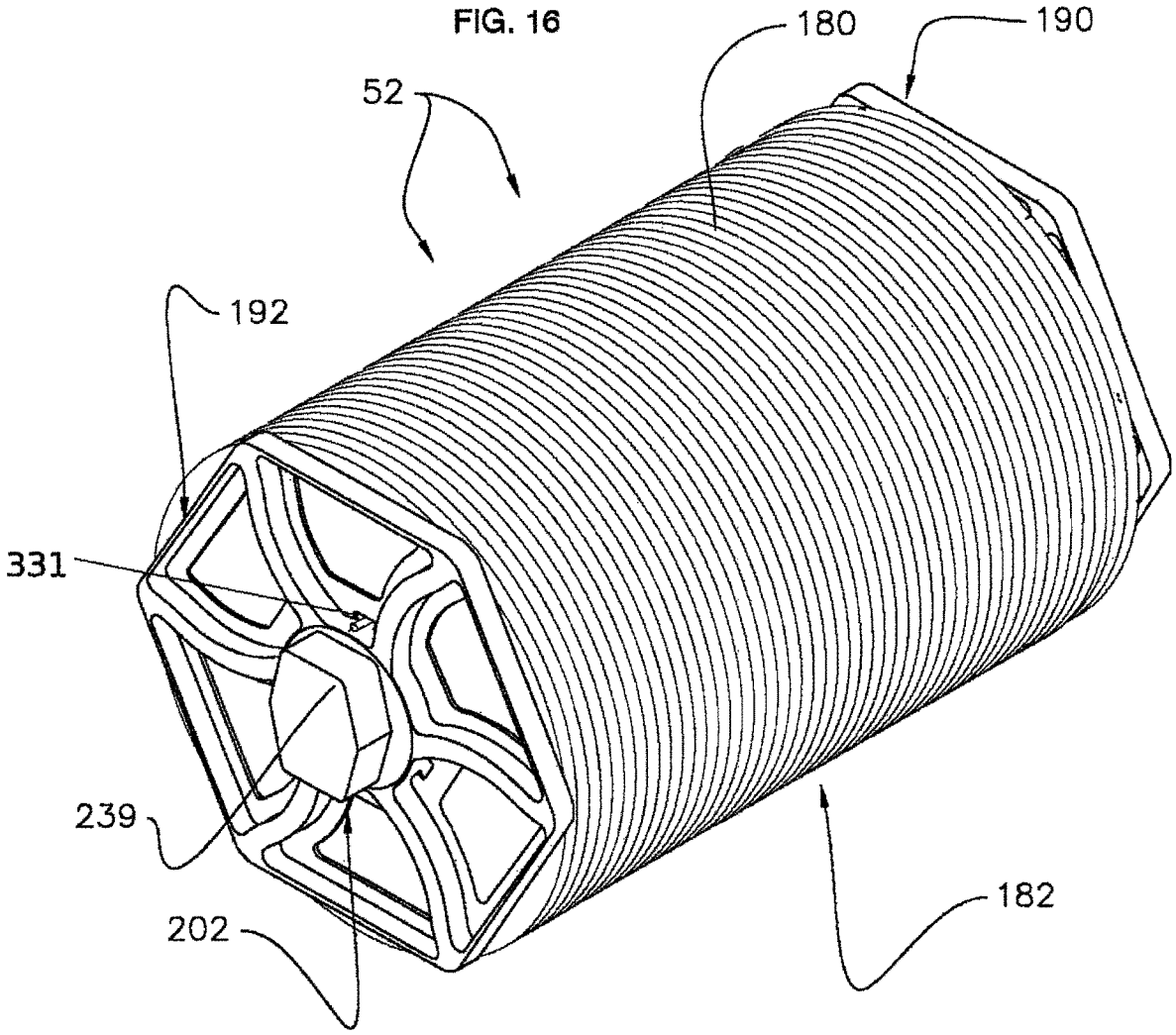
FIG. 16 is a right, frontal isometric view of a cable reel.
Figure 17:
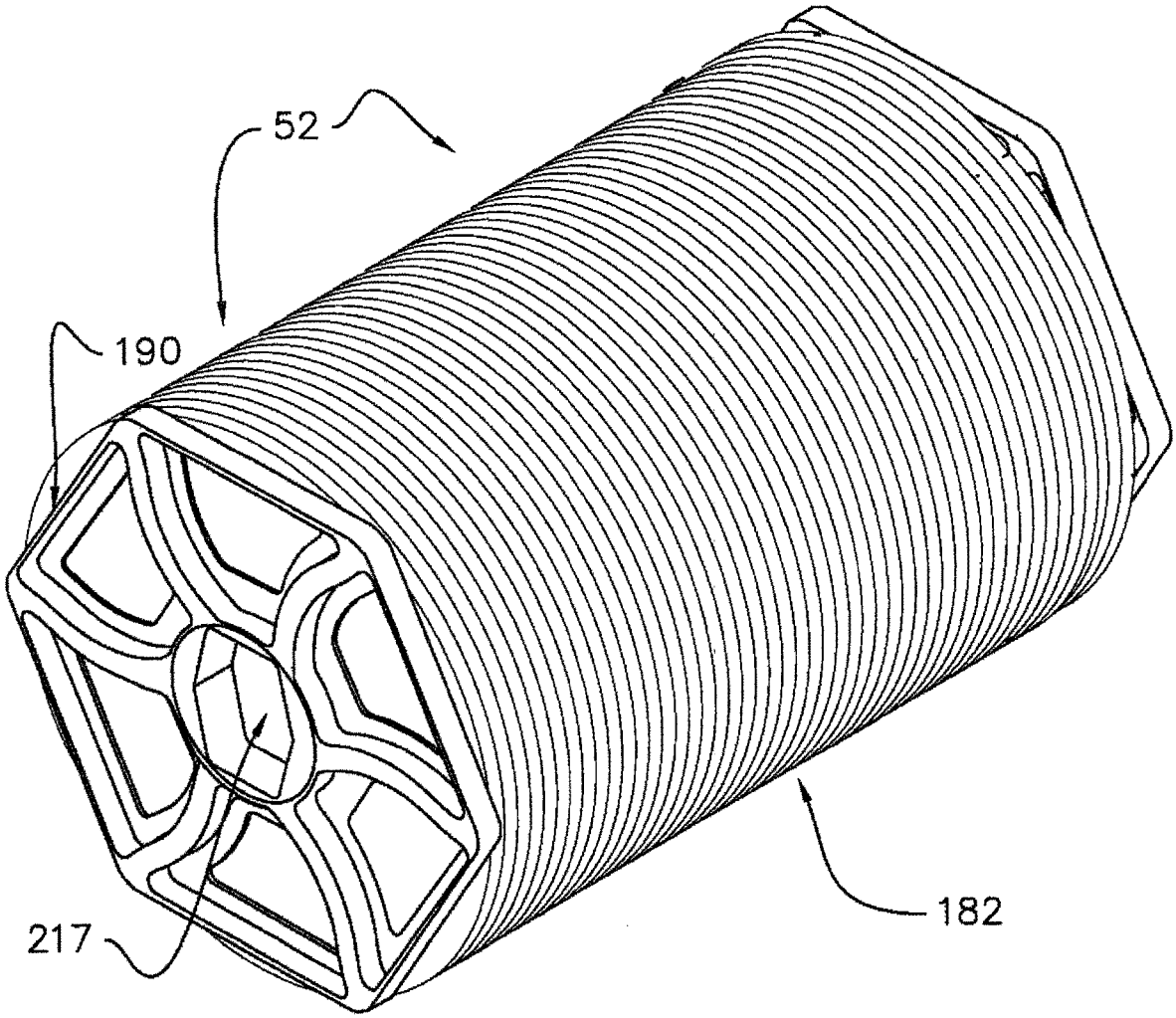
FIG. 17 is a left frontal isometric view of the cable reel.
Figure 18:
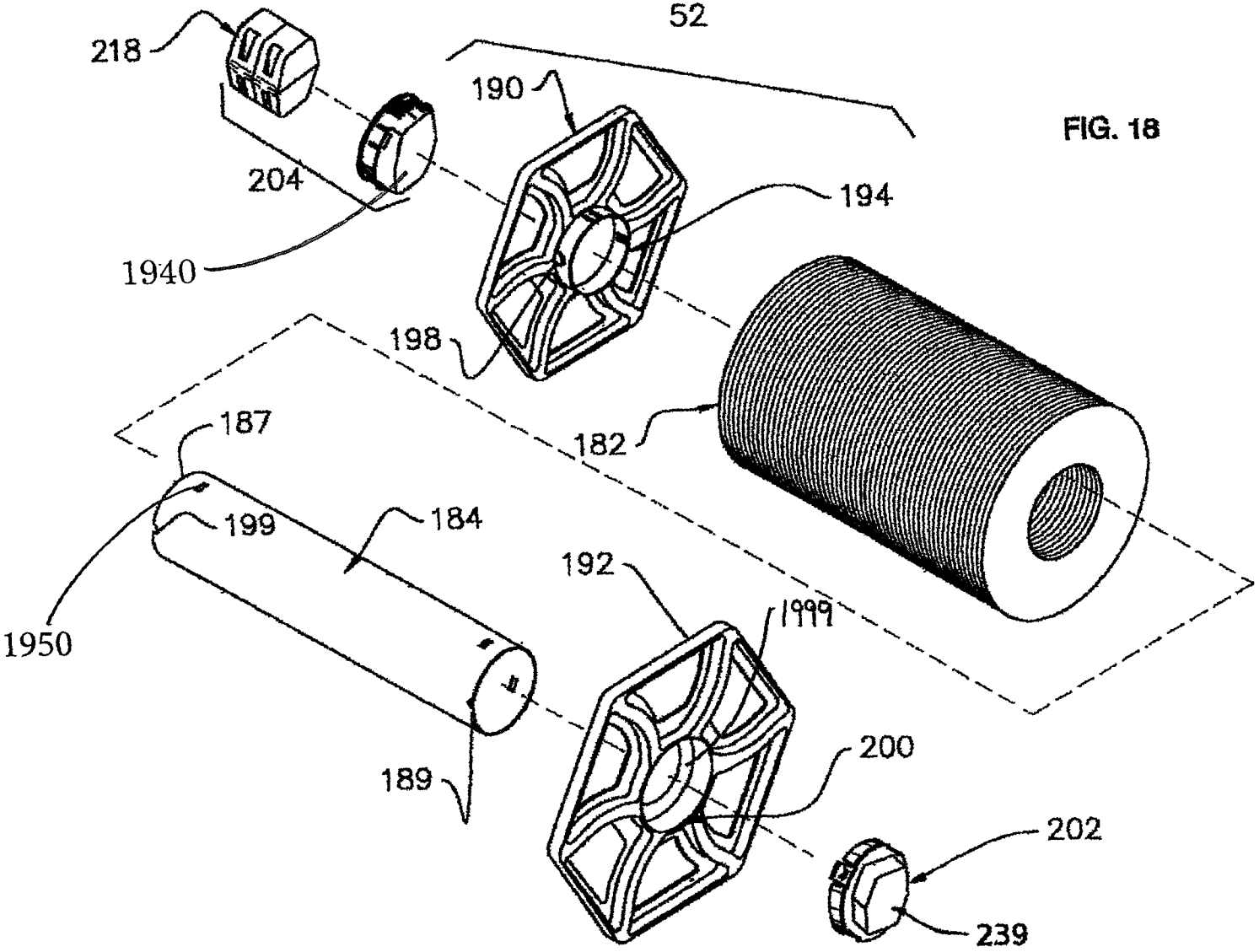
FIG. 18 is an exploded isometric view of the cable reel.

Referring now to FIGS. 16-18, wire or coaxial cable 180 is wound about and stored upon reels 52. Referring to FIG. 18, the reel 52 preferably comprises a spool 182 of cable 180 that is coaxially mounted by a central axle 184 when reels are mounted within a caddy or clamshell housing 50. Opposite ends 187, 189 of axle or drum 184 are coupled to similar, spaced apart end caps 190, 192 (i.e., FIGS. 18, 19). These flange-like end caps 190, 192 restrain wire, cable or other filamentary material wound about the spool 182 and enable rotation. The inner centers of each end cap include circular coupling rings or end cap tubular projections 194 that mate with ends 187, 189 of axle 184 in assembly. The axle ends include projecting notches 199 that register with locks 198 in coupling rings 194. The axle ends include latching holes 1950 for mating with the end caps 190, 192. On their opposite outer ends, the coupling rings 194 have generally circular, recessed bearing races or receivers 200 (FIG. 18) to which spindles or plugs 202, 204/1940 may be fitted. Extending from each bearing race is a race inner lip 1999. A wire end slot 331 is shown in FIG. 16 and provides access to the starting end of the cable 180 on spool 182.

Figure 19:
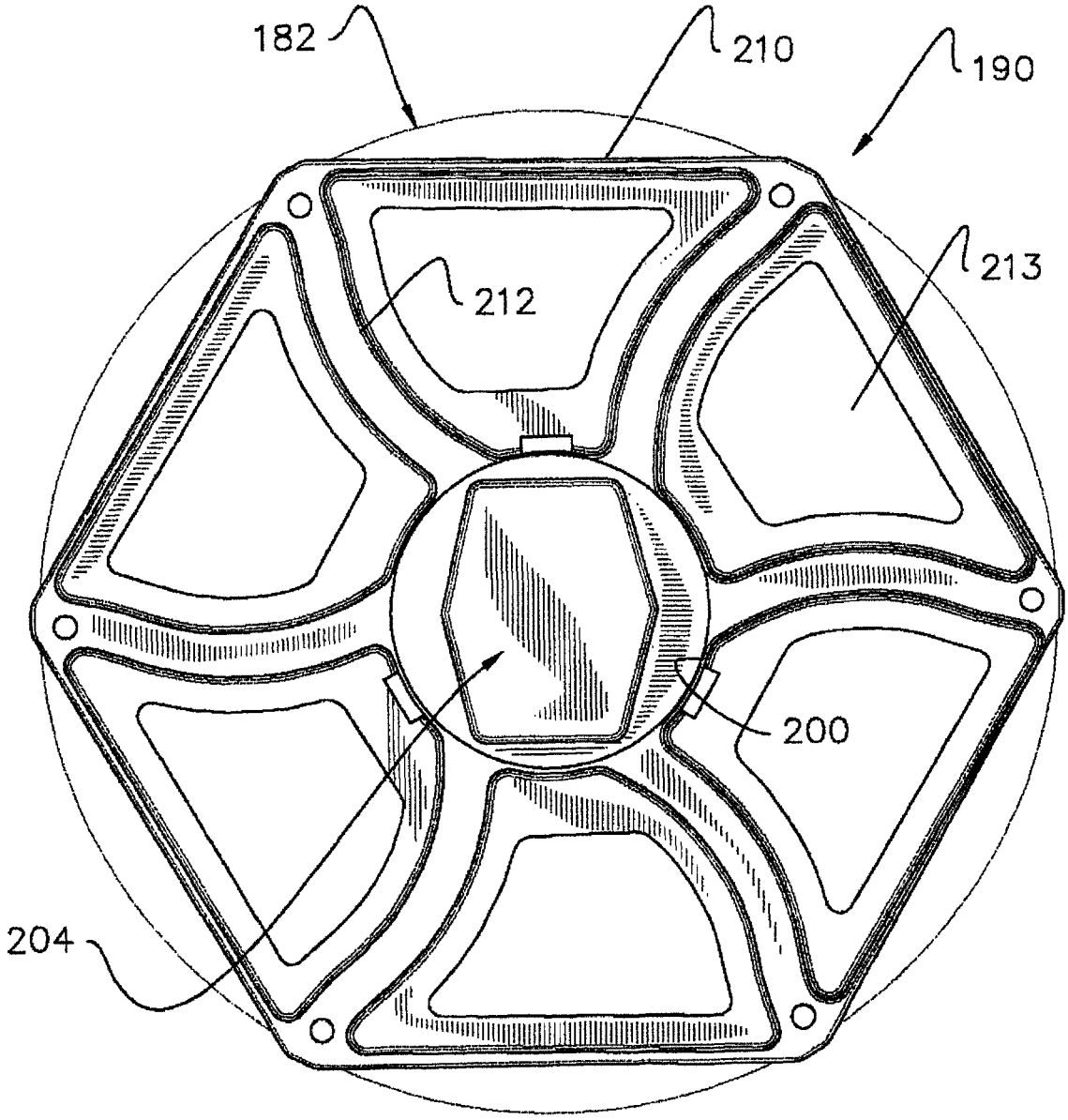
FIG. 19 is an enlarged plan view of a reel end cap.

There are two spindles employed in a preferred embodiment, a unitary, single piece spindle 202, and a multi-piece spindle 204. Each preferably molded plastic spindle includes a bearing portion, and a hub. The spindle bearing portions are fitted to the end cap races 200 to journal the reel 52 for rotation. Spindle hub structures are supported within complementary gudgeons 116A or 111A (FIG. 13) respectively to support the associated reels 52 within the case and enable rotation. The inner axle 184 and end caps 190, 192 thus rotate relative to the spindle hubs to enable reel rotation. Referring to FIG. 19, a preferred embodiment of end cap 190 or 192 is detailed. Spindle 204 is seen mated within the coaxially centered race 200 of the end cap discussed above. Preferably each end cap is polygonal so that the reel is stable when placed on a substantially flat surface and will not roll away. In a preferred embodiment the end caps are either hexagonal or octagonal. Each of the outer facets 210 of the end cap are integral with curved and radially spaced apart spokes 212 that project from the inner hub of the end cap 190. Periodic radially spaced apart voids 213 lighten the end caps. The orientation of of spokes 212 and voids 213 add to the durability of the end cap 190 or 192 by allowing it to more flex on impact and thereby resist permanently deforming or breaking.

Figure 20:
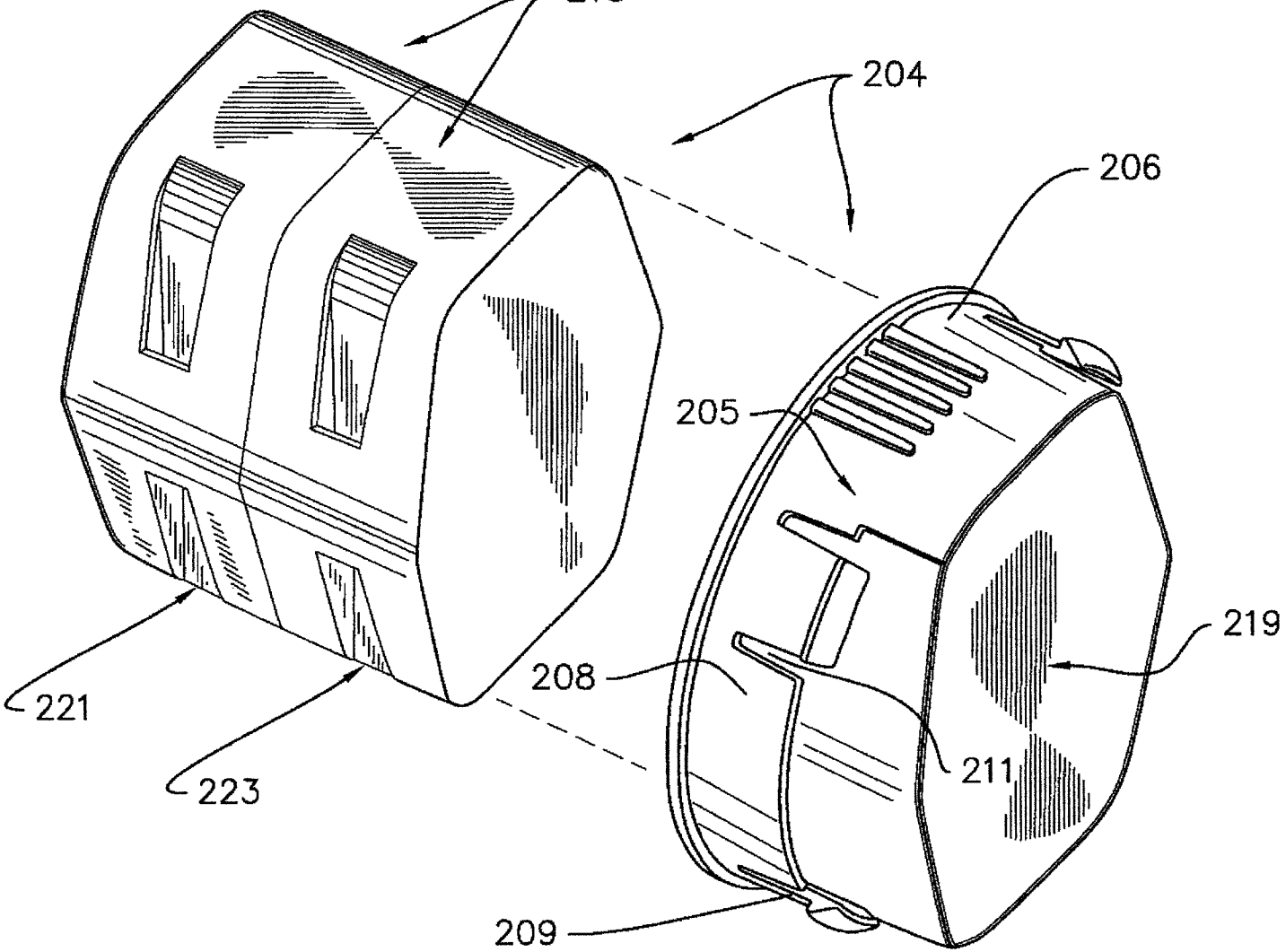
FIG. 20 is an enlarged, exploded isometric view of a multi-part spindle.
Figure 21:
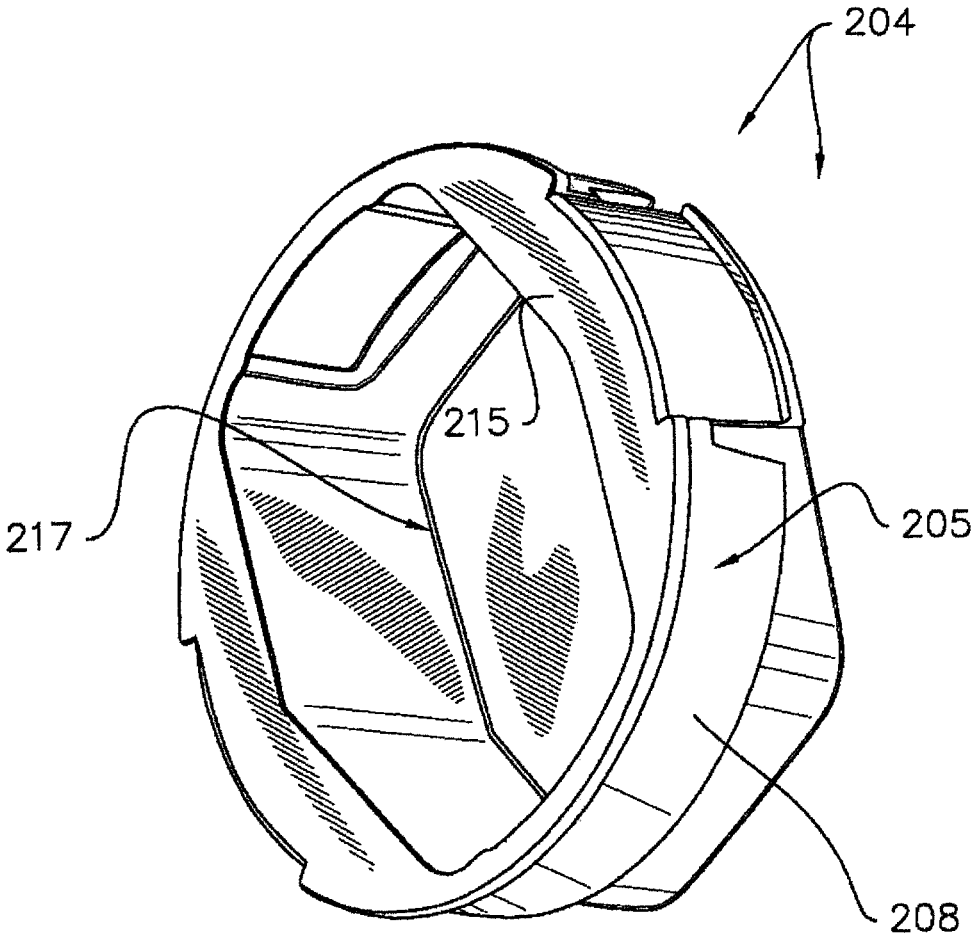
FIG. 21 is an enlarged, isometric view of the inside hub socket associated with the multi-part spindle of FIG. 20.

Referring mainly now to FIGS. 20 and 21, the preferably two-piece spindle 204 comprises a bearing portion 205 comprising a circular, peripheral bearing ring 206. Bearing ring 206 is segmented, comprising curved, peripheral portions 208, 209 that are separated by relief slots 211 to enable resilient bending. Ring 206 engages and yieldably frictionally fits into end cap race 200 (FIG. 19) forming the bearing connection, allowing the end cap and reel to rotate relative to the hub. In an embodiment of the invention, the width of bearing ring 206 in contact with end cap race 200 is preferably between one-half and one inches. The width of the bearing ring 206 is important in providing variable braking as cable is removed, for durability and to sufficiently support the weight of a full reel 52. Ring 206 is integral with a projecting cap portion 219 (FIG. 20) that interiorly defines a recessed socket 217 (FIG. 21) at its opposite end. A separate, removable key 218 (FIGS. 18, 18A, 20) is removably fitted to spindle bearing portion 205 (FIG. 20), being received within socket 217 (FIG. 21).

Key 218 (FIG. 20) comprises a pair of adjoining, preferably similarly shaped portions 221 and 223. The key's hub 221 is designed to seat within a gudgeon 111A in assembly when a reel is placed within the caddy. The neighboring plug 223 (FIG. 20) is adapted to fit within socket 217 provided by the spindle bearing portion 205 (FIGS. 20, 21). With a reel disposed within the caddy, the projecting key 218 now coupled to socket 217 by plug 223 projects its hub 221 towards bearing gudgeon 111A (FIG. 13). Alternatively, when reels are shipped from the factory, or when reels are moved or stored about a work site, the key 218 can be removed from spindle 204, exposing hub socket 217 (FIG. 21) that can now receive the hub 239 (FIGS. 18, 22) from a unitary spindle 202 projecting upwardly from another reel below it, as when multiple reels are vertically stacked. When reels are to be mounted in the caddy for use, the removable key 218 is reconnected to spindle 204 and seats within a gudgeon to establish reel rotation.

The "security key" 218 can be adapted to allow only specific reels to fit within a caddy. In other words, the configuration of the plug 223 (FIGS. 18, 20) can be matched to specific, complementary sockets 217 (FIG. 21), so that specific reels cannot be rotatably disposed within a caddy unless the user has a properly configured key 218 (i.e., the proper "key") to fit within the given socket 217. Alternatively, the design of the receptive case gudgeons 111A or 116A can be custom configured so that a given caddy will receive and mount only a specific reel with specifically configured keys 218, associated with spindled 204, or hubs 239 (FIG. 22) associated with spindle 202. As a result, specific reel designs can be custom defined for specific customers or specific jobs using specific caddies, enabling rapid identification, reducing mistakes, and reducing the likelihood of theft.

Figure 22:
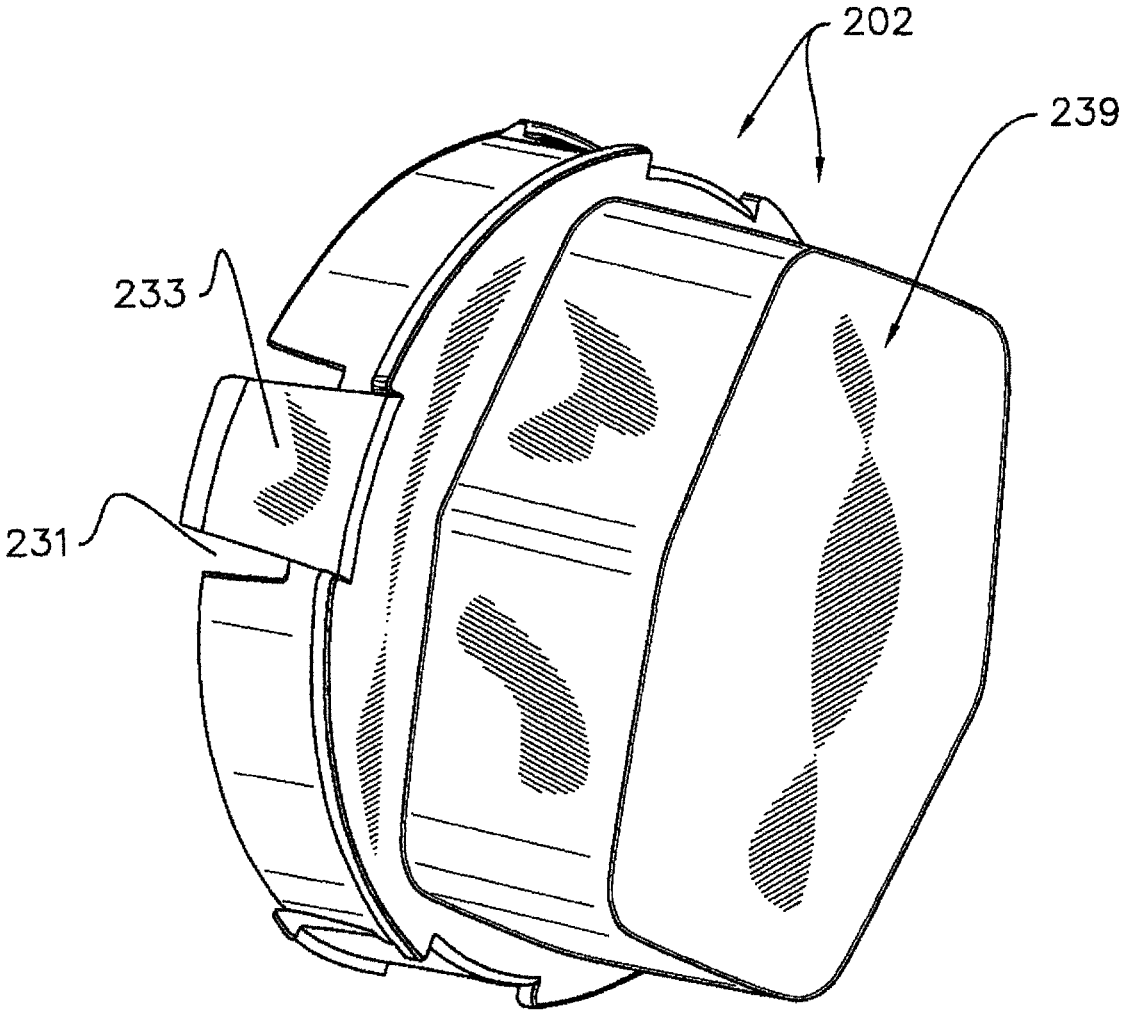
FIG. 22 is an enlarged isometric view of a unitary spindle.
Figure 23:
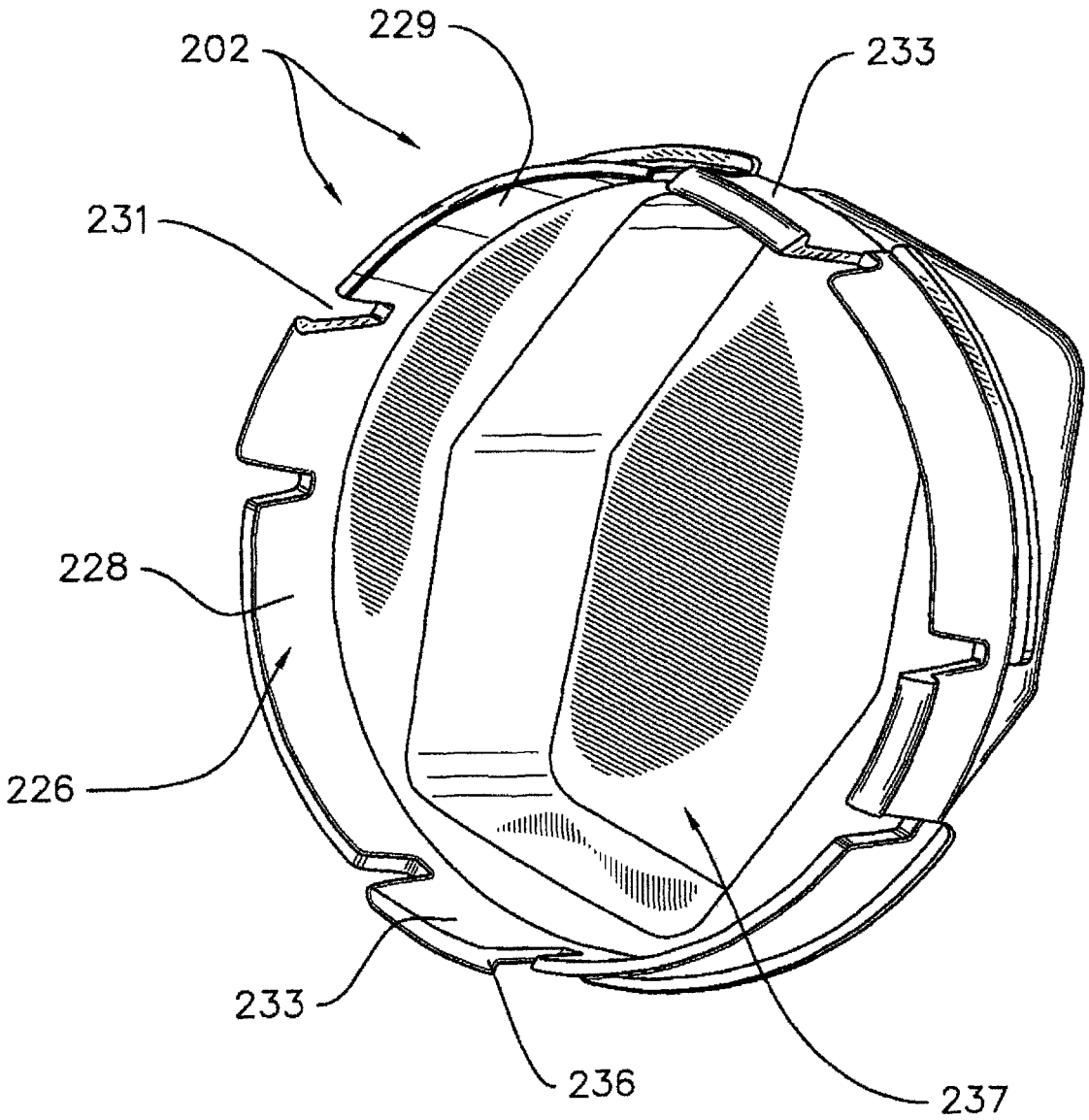
FIG. 23 is an enlarged isometric view of the spindle of FIG. 22, but showing the inside.

In FIGS. 22 and 23 the permanently attached, unitary spindle 202 is detailed. An integral, outer, peripheral bearing ring 226 is also segmented, comprising separated curved portions 228, 229 for example, that are separated by relief slots 231 to enable resiliency. The width of bearing ring 226 is preferably the same as the width of bearing ring 206.

Preferably there are four radially spaced apart, barbed tabs 233 comprised of outwardly facing barbs 236 that engage with a inner lip of the race 200 (FIG. 18) and snap into place. Barbs 236 axially lock the spindle 202 within the race 200 for rotation of the spindle. Thus bearing ring 226 journals the spindle for rotation. The resilient plastic construction enables yieldable frictional fitting of the spindle 202 to the end cap (FIG. 18) where it is permanently seated. Ring 226 borders a frontal, recessed interior 237. Recess 237 forms the underside of an integral projecting hub 239 (FIG. 22) at an opposite end that is normally seated within a caddy inner gudgeon 111A or 116A (FIG. 13) to enable reel rotation. The removable key 218 (FIG. 18) that is associated with spindle 204 may have its hub portion 221 geometrically configured similarly to hub portion 239 on spindle 202; however, both hub portions 221 and 239 have the same function, and both are seated within caddy inner gudgeons 111A and 116A. Alternatively, when reels are shipped or moved, hub portion 239 of a spindle 202 can engage another spool above it, nesting within an exposed socket 217 (FIGS. 18, 21) in another spindle 204 whose key 218 (FIG. 20) has been removed. Normally, hub portion 239 will seat within a gudgeon 116A (FIG. 13) when a reel is disposed within a caddy, and the spool can thus rotate relative to the hub and its receptive gudgeon.

Figure 18A:
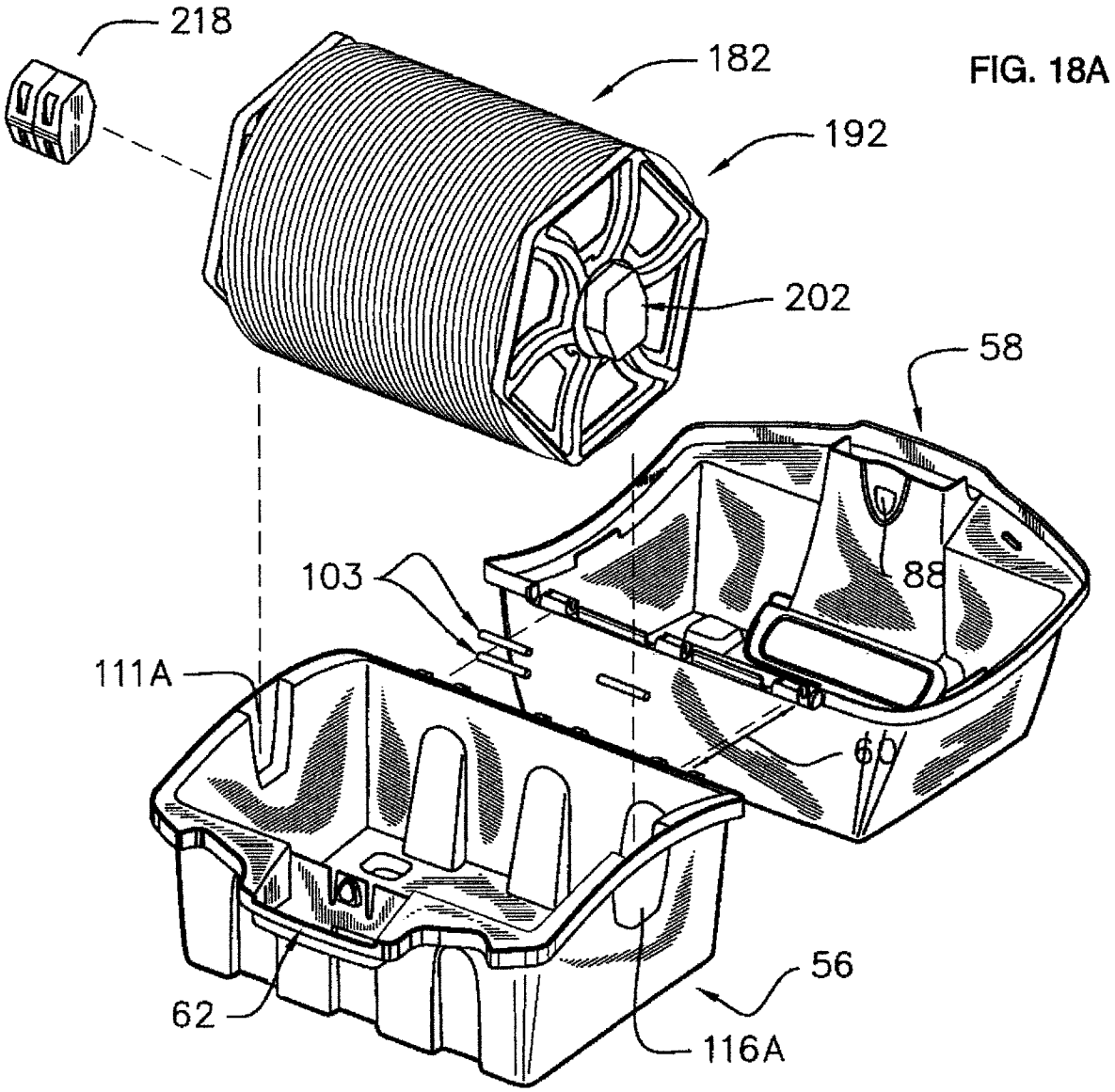
FIG. 18A is an exploded isometric view of a caddy and reel assembly.
Figure 24:
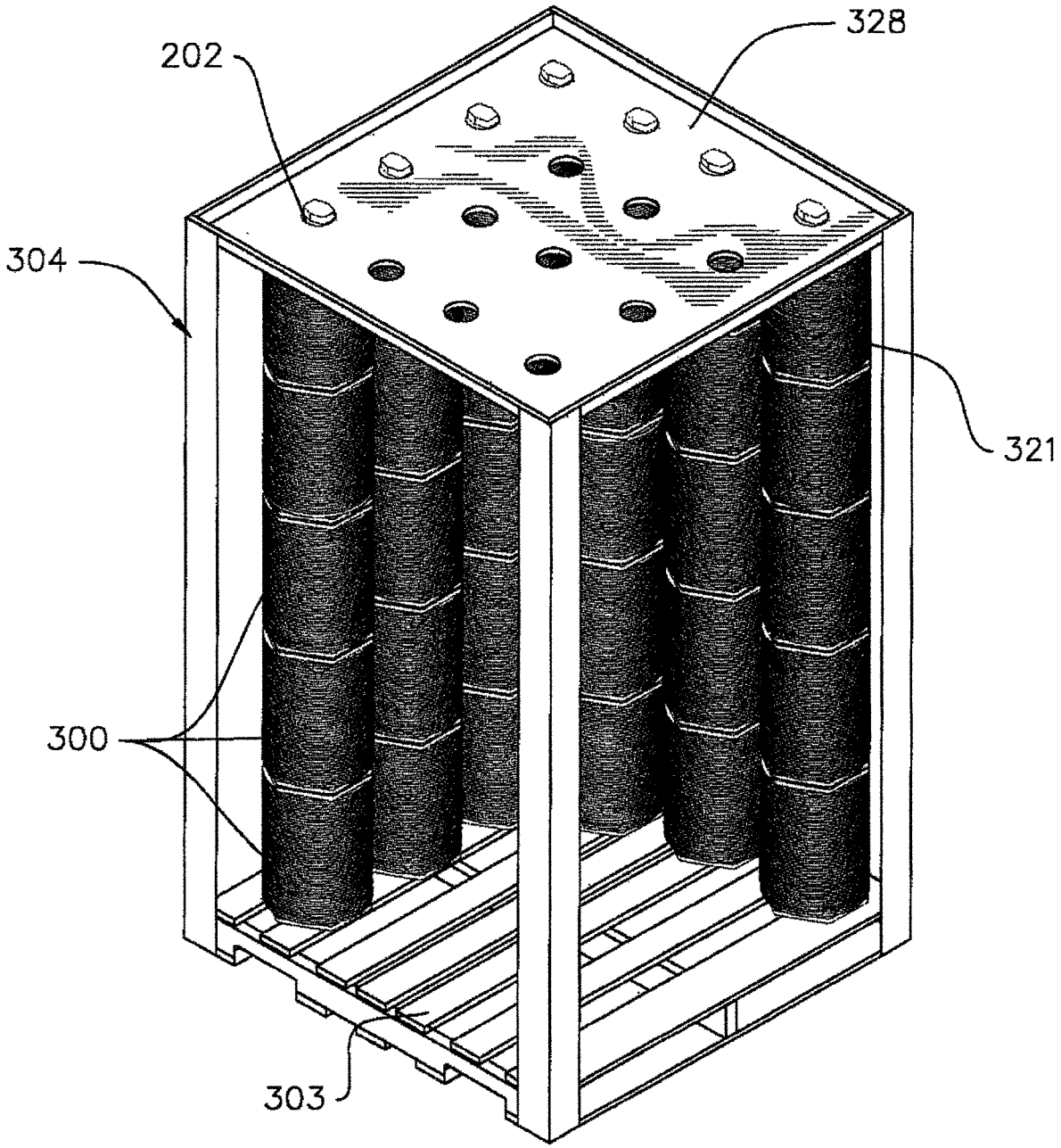
FIG. 24 is an isometric view showing a plurality of stacked reels on a pallet.

FIG. 24 illustrates how a plurality of separate reels 300 may be conveniently stacked in a pallet. Here the reels 300 are arranged in multiple, spaced-apart vertical stacks forming columns upon floor 303 of the pallet 304. For most of the reels, their upwardly projecting, permanent spindles 202 mate with upper reels. Specifically, the hubs 239 of spindles 202 fit within an exposed socket 217 (FIG. 21) that are unblocked and exposed by removal of the security key 218 of spindle 204 (FIG. 18) discussed earlier. However, the uppermost reels 321 (FIG. 24) have their spindles 202 seated within suitable spaced apart orifices defined in the roof 328 of pallet 304. FIG. 24 also illustrates how stability of the stacks is increased and volume required is decreased by the polygonal shape of reel endcaps 190 (FIG. 19) and 192 (FIG. 18A). The flat edge of the polygonal endcaps 190, 192 abut with a greater contact area than a circular shaped endcap.

Figure 25:
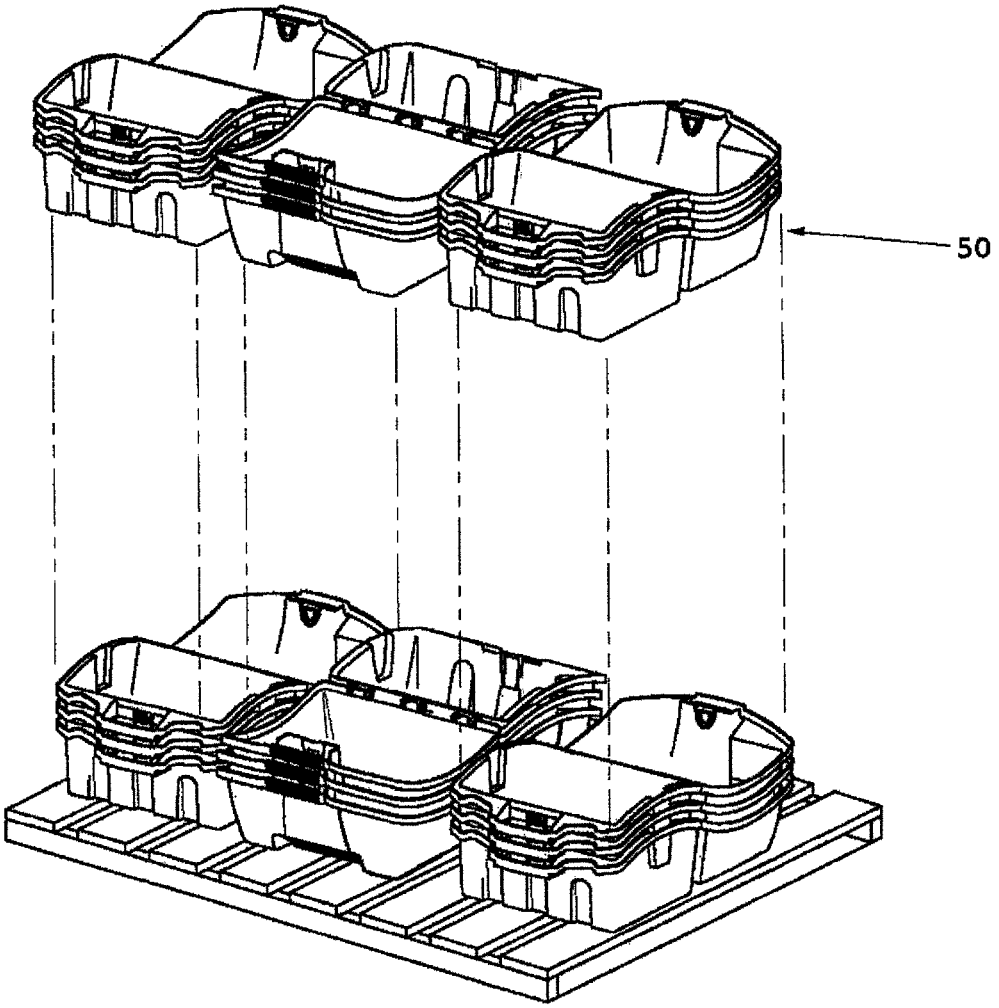
FIG. 25 is an isometric view showing a plurality of stacked and nested cases disposed on a pallet.

FIG. 25 illustrates how empty caddies 50 can be stacked for shipment. The caddies are opened as illustrated and stacked such that the lower base 56 of an upper unit is nested within the lower base of a lower unit. Similarly the top 58 of one unit, inverted by folding, is nested within the top of a similarly folded lower caddy. This minimizes shipping volume.

Figure 26:
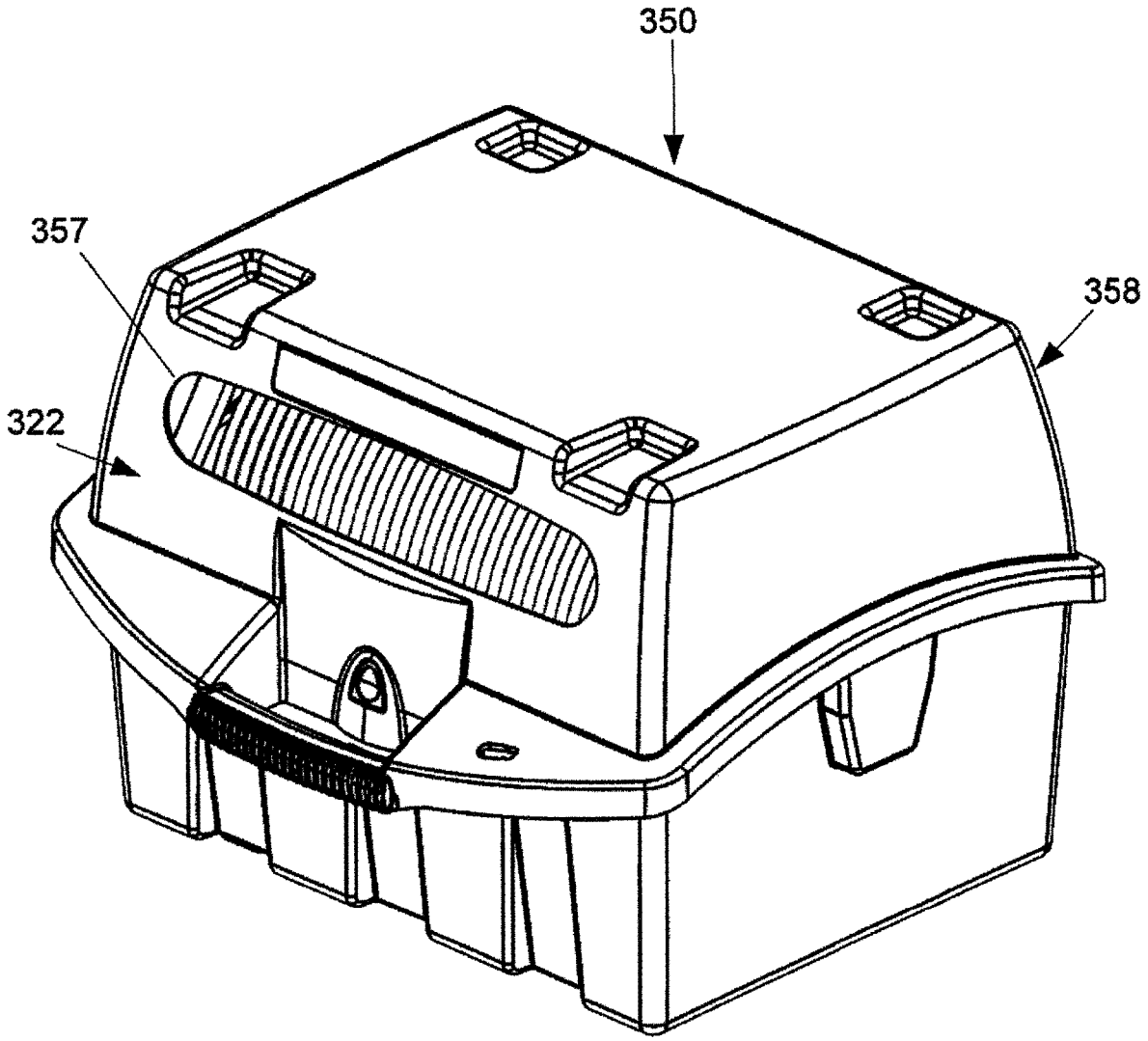
FIG. 26 is a frontal isometric view of an alternative embodiment of our cable reel caddy, with the caddy closed.

FIG. 26 shows an alternative embodiment of a portable caddy 350. Caddy 350 has an alternative top 358 and is otherwise similar to caddy 50 shown in FIG. 1. The caddy top 358 has a front panel 322 with a mouth 357. Mouth 357 is approximately centered on front panel 322 and extends preferably eighty percent of the width of front panel 322 and preferably fifty percent of the height of front panel 322. Other embodiments of mouth 357 may be larger or smaller.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A caddy system for enclosing, transporting and dispensing cable, the caddy system comprising:
- a clamshell housing for enclosing a tubular drum that holds a coil of electrical cable;
- inserted in each end of the drum is a tubular projection of an end cap;
- opposite the tubular projections are receivers within each end cap;
- rotatably inserted in the receivers are first and second plugs;
- a key irrotatably inserted in the housing is irrotatably inserted in the first plug; and,
- the second plug is irrotatably inserted in the housing such that the drum and end caps rotate about the plugs.

2. The caddy system of claim 1 further including:
- a drum first end with latching holes and a drum second end with latching holes.

3. The caddy system of claim 2 further including:
- tubular projection spring tabs that mate with the latching holes.

4. The caddy system of claim 1 wherein the housing includes molded "V" shaped hangers for receiving the key and the second plug.

5. The caddy system of claim 1 wherein the end caps have six sides.

6. The caddy system of claim 5 wherein the key has six sides.

7. The caddy system of claim 6 wherein the second plug has six sides.

8. The caddy system of claim 1 further comprising a slot located along a top edge of the housing near a housing handle for dispensing cable therethrough.

9. The caddy system of claim 1 wherein a key cross section is shaped like a rectangle with a triangle at either end.

10. A caddy system for enclosing, transporting and dispensing cable, the caddy system comprising:
- a clamshell housing for enclosing a tubular drum for holding a coil of electrical cable;
- inserted in each end of the drum is a tubular projection of an end cap;
- the drum and end caps included in a reel;
- opposite the tubular projections are receivers within each end cap;
- for rotatably insertion in the receivers are first and second plugs;
- for irrotatable insertion in the housing is a key for irrotatable insertion in the first plug; and,
- for irrotatable insertion in the housing is the second plug such that the drum and end caps rotate about the plugs.

11. The caddy system of claim 10 wherein reels holding electrical cable are stacked with a second plug of first reel inserted in a first plug of a second reel.

12. The caddy system of claim 11 wherein housings that are opened are stacked with a first housing fitting substantially within a second housing.

13. The caddy system of claim 12 wherein closed housings having reels within are stacked such that indentations on a first housing top receive feet on a second housing bottom.

14. A method of providing a caddy for enclosing, transporting and dispensing cable, steps of the method comprising:
- providing a clamshell housing for enclosing a tubular drum that holds a coil of electrical cable;
- inserting in each end of the drum is a tubular projection of an end cap the drum and the end caps forming a reel;
- providing in each end cap a receiver opposite the tubular projections;
- rotatably inserting in the receivers first and second plugs;
- irrotatably inserting a key in the housing and irrotatably inserting the key in the first plug; and,
- irrotatably inserting the second plug in the housing such that the reel rotates about the plugs.

15. The method of claim 14 wherein the reel is removed from the housing when the key and the second plug are no longer within molded "V" shaped slots in a lower half of the housing.

* * * * *